US008770571B2

(12) United States Patent
Ando et al.

(10) Patent No.: US 8,770,571 B2
(45) Date of Patent: Jul. 8, 2014

(54) SHEET STACKING APPARATUS

(75) Inventors: Yutaka Ando, Toride (JP); Shunsuke Nishimura, Tokyo (JP); Takashi Yokoya, Kashiwa (JP); Hitoshi Kato, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/553,544

(22) Filed: Jul. 19, 2012

(65) Prior Publication Data

US 2013/0032991 A1 Feb. 7, 2013

(30) Foreign Application Priority Data

Aug. 4, 2011 (JP) ..... 2011-171106

(51) Int. Cl.
*B65H 31/34* (2006.01)
*B65H 9/10* (2006.01)

(52) U.S. Cl.
USPC ..... 270/58.17; 270/58.11; 270/58.12; 270/58.27

(58) Field of Classification Search
USPC ..... 270/58.11, 58.12, 58.16, 58.17, 58.27
See application file for complete search history.

(56) References Cited

U.S. PATENT DOCUMENTS

| | | | | |
|---|---|---|---|---|
| 5,092,509 | A * | 3/1992 | Naito et al. | 227/99 |
| 6,889,974 | B2 * | 5/2005 | Tamura et al. | 271/220 |
| 8,251,362 | B2 * | 8/2012 | Konishi | 270/58.17 |
| 2009/0243198 | A1 * | 10/2009 | Konishi | 271/221 |

FOREIGN PATENT DOCUMENTS

| | | | |
|---|---|---|---|
| EP | 355751 | A2 | 2/1990 |
| JP | 2006-206331 | A | 8/2006 |

* cited by examiner

*Primary Examiner* — Leslie A Nicholson, III
(74) *Attorney, Agent, or Firm* — Canon USA, Inc., IP Division

(57) ABSTRACT

A sheet stacking apparatus includes an alignment unit configured to align a sheet stacked on a stacking tray in a width direction which is orthogonal to a direction in which the sheet is discharged. The alignment unit includes first and second alignment members configured to move in the width direction. The first and second alignment members come into contact with side ends in the width direction of the sheet stacked on the stacking tray to align the sheet. When a second sheet of a different length in the width direction from that of a first sheet is stacked while shifted in the width direction on the first sheet which is already stacked on the stacking tray, the sheet stacking apparatus prohibits an alignment operation of the alignment unit on the second sheet.

10 Claims, 17 Drawing Sheets

FRONT SIDE VIEW

VIEW AS SEEN FROM SHEET DISCHARGE SIDE

ALIGNMENT POSITION

RETRACTED POSITION

ALIGNMENT PLATE INITIAL POSITION

ALIGNMENT PLATE STANDBY POSITION

ALIGNMENT PLATE ALIGNMENT POSITION

ALIGNMENT PLATE STANDBY POSITION

FIG.9A
ALIGNMENT PLATE POSITION AT COMPLETION OF ALIGNMENT

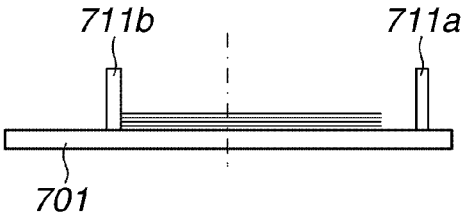

FIG.9B
ALIGNMENT PLATE POSITION WHEN SPACED AWAY FROM TRAY

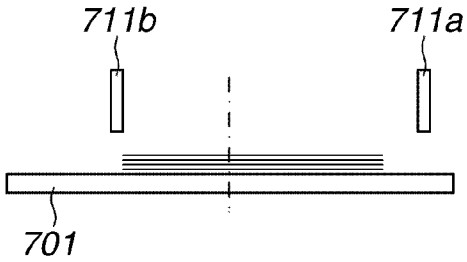

FIG.9C
ALIGNMENT PLATE POSITION FOR RECEIVING NEXT SHEET

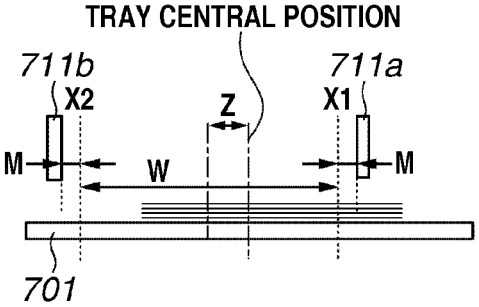

FIG.9D
ALIGNMENT PLATE POSITION WHEN ABUTTING ALREADY STACKED SHEET

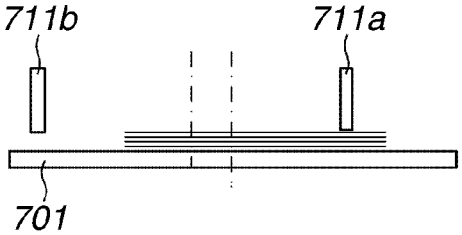

FIG.9E
ALIGNMENT PLATE POSITION WHEN SHEET IS DISCHARGED

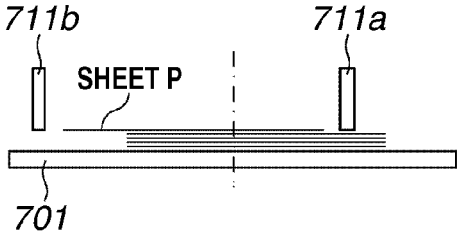

FIG.9F
ALIGNMENT PLATE POSITION AT ALIGNMENT

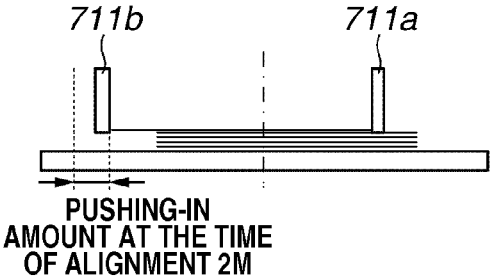

FIG.9G
ALIGNMENT PLATE POSITION WHEN AT ALIGNMENT STANDBY POSITION

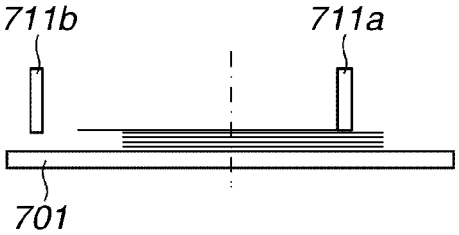

FINISHING SELECTION SCREEN

FINISHING SELECTION SCREEN

SHEET DISCHARGE DESTINATION SELECTION SCREEN

APPLICATION MODE SELECTION SCREEN

DOCUMENT SIZE MIXED STACKING SCREEN

SHEET STACKING APPARATUS

BACKGROUND OF THE INVENTION

1. Field of the Invention

The present invention relates to a sheet stacking apparatus having a function of aligning sheets stacked on a stacking tray.

2. Description of the Related Art

Regarding a sheet stacking apparatus which is connected to an image forming apparatus and configured to stack a large amount of sheets, there has been a growing trend toward a requirement for a performance enabling sheets to be aligned with high accuracy before being discharged.

Japanese Patent Application Laid-Open No. 2006-206331 discusses an apparatus in which an alignment member is provided on a stacking tray, and the sheet end surfaces are aligned by attaching and separating the alignment member to and from the sheet end surfaces parallel to the sheet discharge direction to stack the sheets together.

However, in a case where sheets of a sheet width W1 are stacked on a stacking tray 701 and sheets of a sheet width W2 different from the sheet width W1 are stacked on the sheets of the sheet width W1, it is necessary to eliminate a gap between the already stacked sheets and the bottom surface of each alignment plate. For this purpose, as illustrated in FIG. 17, it is necessary for alignment plates A and B to abut the upper surface of the uppermost one of the sheets already stacked. When, in the state in which the alignment plates are in contact with the upper surface of the uppermost one of the stacked sheets, the alignment plate A moves in the directions indicated by an arrow in FIG. 17, the bottom surface of the alignment plate A is rubbed against the uppermost one of the stacked sheets. This leads to separation of the toner on the sheet, so that there is a fear of deterioration in image quality.

Further, when the bottom surface of the alignment plate with toner adhering thereto comes into contact with another sheet, the toner will be allowed to adhere to this sheet, so that there is a fear of deterioration in the image quality.

Further, even in a place where no toner image is formed, the sheet surface is rubbed against the alignment plate, and sheet quality may be deteriorated.

SUMMARY OF THE INVENTION

Embodiments of the present invention are directed to a sheet stacking apparatus capable of preventing damage of sheets stacked on a stacking tray. Further, embodiments are directed to a sheet stacking apparatus capable of preventing deterioration in the image quality of the sheets stacked on the stacking tray.

According to an aspect of the present invention, a sheet stacking apparatus includes a discharge unit configured to discharge a sheet, a stacking tray on which the sheet to be discharged by the discharge unit is stacked, an alignment unit configured to align the sheet stacked on the stacking tray in a width direction which is orthogonal to a direction in which the sheet is discharged, the alignment unit includes first and second alignment members configured to move in the width direction and to come into contact with side ends in the width direction of the sheet stacked on the stacking tray to align the sheet, and a control unit configured to, on a first sheet stacked on the stacking tray, when a second sheet of a different length in the width direction from a length of the first sheet is stacked while shifted in the width direction, prohibit an alignment operation by the alignment unit on the second sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 9A through 9G illustrate sheet alignment operations on the stacking tray when in a shift sort mode.

DESCRIPTION OF THE EMBODIMENTS

Various exemplary embodiments, features, and aspects of the invention will be described in detail below with reference to the drawings.

Figure 1:
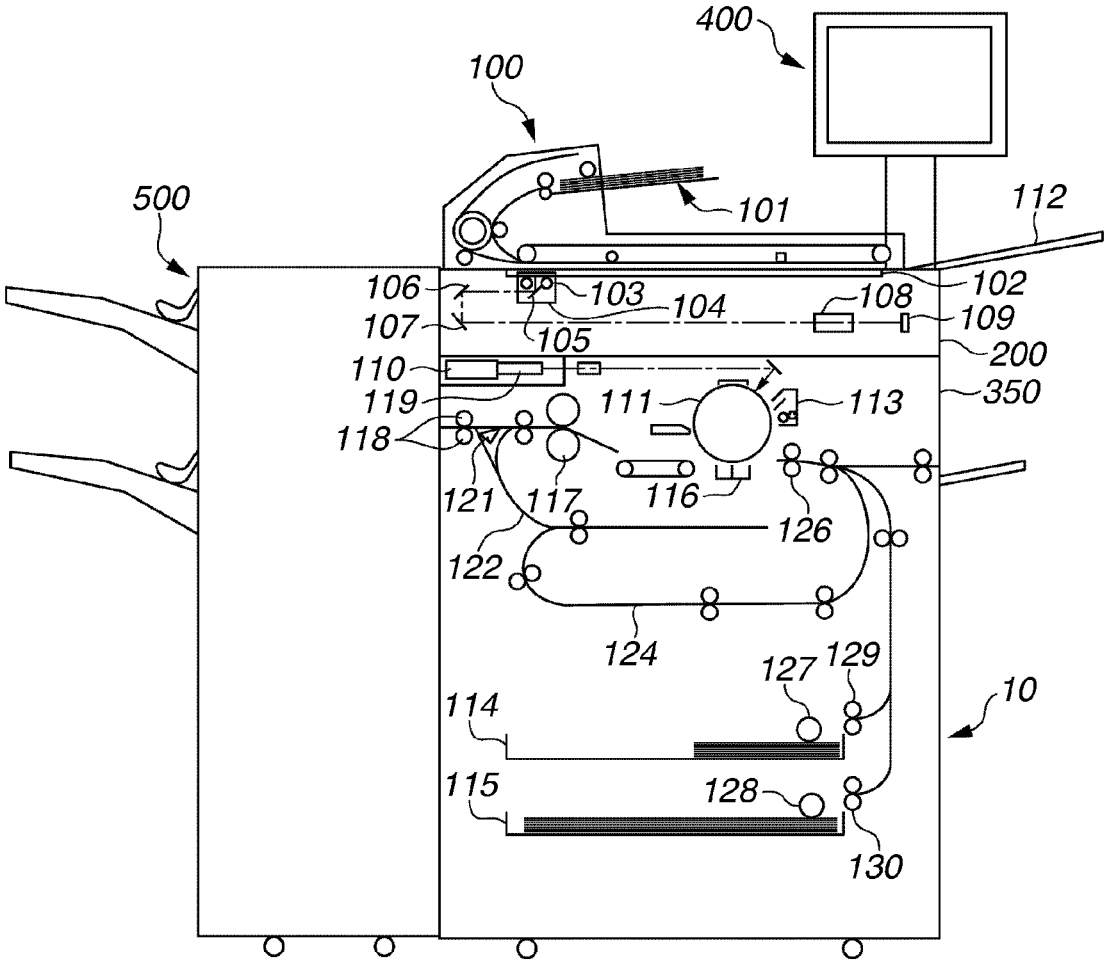
FIG. 1 is a sectional view of an image forming apparatus.

FIG. 1 is a longitudinal sectional view illustrating the structure of a main portion of an image forming system. The image forming system includes an image forming apparatus 10 and a finisher 500 serving as a sheet stacking apparatus. The image forming apparatus 10 is equipped with an image reader 200 configured to read an image from a document and a printer 350 configured to form the read image on a sheet.

A document feeding apparatus 100 feeds documents set face up on a document tray 101 one by one starting with the first page, and conveys them to a predetermined reading position on a platen glass 102. Then, the document feeding apparatus 100 discharges the documents onto a discharge tray 112. At this time, a scanner unit 104 is fixed at a predetermined reading position. When a document passes the reading position, the image of the document is read by the scanner unit 104. More specifically, when the document passes the reading position, the document is irradiated with the light of a lamp 103 of the scanner unit 104, and the reflected light from the document is guided to a lens 108 via mirrors 105, 106, and 107. The light passed through the lens 108 forms an image on the imaging surface of an image sensor 109, and the image is converted to image data and output. The image data output from the image sensor 109 is input to an exposure unit 110 of the printer 350 as a video signal.

The exposure unit 110 of the printer 350 modulates the laser beam based on the video signal input from the image reader 200 and outputs the modulated laser beam. The laser beam is applied to a photosensitive drum 111 while undergoing scanning by a polygon mirror. An electrostatic latent image corresponding to the scanned laser beam is formed on the photosensitive drum 111. The electrostatic latent image on the photosensitive drum 111 is visualized as a developer image by developer supplied from a developing device 113.

A sheet is fed from an upper cassette 114 or a lower cassette 115 provided within the printer 350 by a pickup roller 127 or 128. The fed sheet is conveyed to registration rollers 126 by sheet feeding rollers 129 or sheet feeding rollers 130. When the leading edge of the sheet reaches the registration rollers 126, the registration rollers 126 are driven with a predetermined timing, and the sheet is conveyed to a gap between the photosensitive drum 111 and a transfer unit 116. The developer image formed on the photosensitive drum 111 is transferred to the fed sheet by the transfer unit 116.

The sheet to which the developer image has been transferred is conveyed to a fixing unit 117, which fixes the developer image onto the sheet by applying heat and pressure to the sheet. The sheet passed through the fixing unit 117 is discharged from the printer 350 toward the exterior of the image forming apparatus (the finisher 500) by way of a flapper 121 and discharge rollers 118. When image formation is performed on both sides of the sheet, the sheet is conveyed to a two-sided conveyance path 124 via a reversing path 122 and is further conveyed to the registration rollers 126 again.

Figure 2:
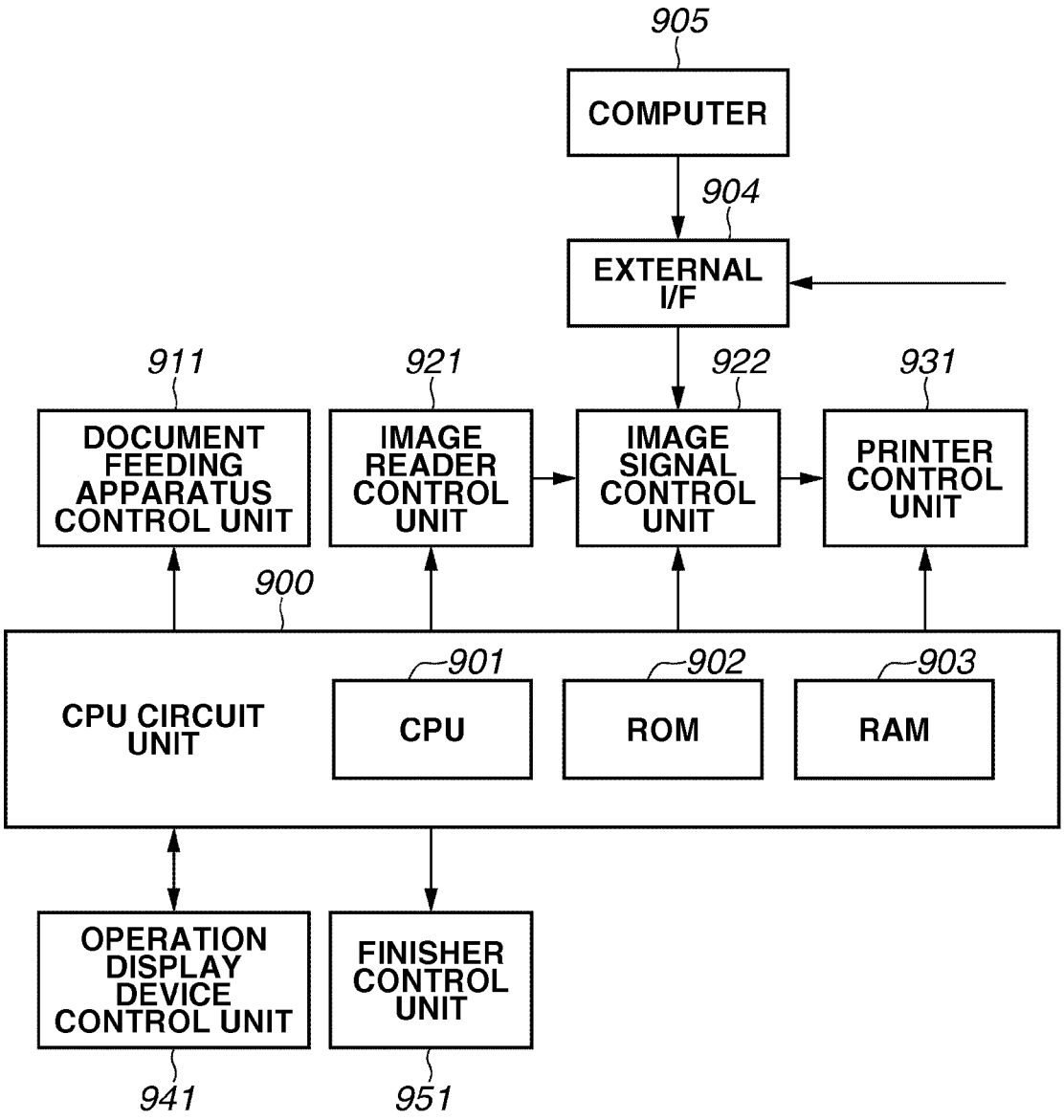
FIG. 2 is a block diagram illustrating a configuration of an image forming system.

The configuration of a controller which controls the present image forming system as a whole and the overall system configuration is described with reference to the block diagram in FIG. 2. FIG. 2 is the block diagram illustrating the configuration of the controller for controlling the image forming system as a whole in FIG. 1.

As illustrated in FIG. 2, the controller includes a central processing unit (CPU) circuit unit 900, and the CPU circuit unit 900 contains a CPU 901, a read-only memory (ROM) 902, and a random-access memory (RAM) 903. The CPU 901 is a CPU for performing the basic control of the entire present image forming system, and the ROM 902 to which a control program is written and the RAM for performing the processing are connected to the CPU 901 by an address bus and a data bus. The CPU 901 collectively controls various types of control units 911, 921, 922, 904, 931, 941, and 951 by the control program stored in the ROM 902. The RAM 903 temporarily stores the control data and is used as an operation area for a computation processing involved in the control.

The document feeding apparatus control unit 911 controls the drive of the document feeding apparatus 100 based on a command from the CPU circuit unit 900. The image reader control unit 921 controls the drive of the scanner unit 104, the image sensor 109, and the like, and transfers an image signal output from the image sensor 109 to the image signal control unit 922. The image signal control unit 922 performs each processing after converting the analog image signal from the image sensor 109 to a digital signal, and converts the digital signal to a video signal to output it to the printer control unit 931. Further, the image signal control unit 922 performs various types of processing on a digital image signal input from the computer 905 via an external interface (I/F) 904, and converts the digital image signal to a video signal to output it to the printer control unit 931. The processing operation by the image signal control unit 922 is controlled by the CPU circuit unit 900.

The printer control unit 931 controls the exposure unit 110 and the printer 350 based on the input video signal and performs image formation and sheet conveyance. The finisher control unit 951 is mounted in the finisher 500, and controls the drive of the entire finisher through information exchange with the CPU circuit unit 900. The content of the control is described in detail below. The operation display device control unit 941 exchanges information between an operation display device 400 and the CPU circuit unit 900. The operation display device 400 includes a plurality of keys for setting various functions related to image formation, a display unit for displaying information indicating the setting condition, and the like. A key signal corresponding to each key is output to the CPU circuit unit 900, and corresponding information is displayed on the operation display device 400 based on a signal from the CPU circuit unit 900.

Figure 3:
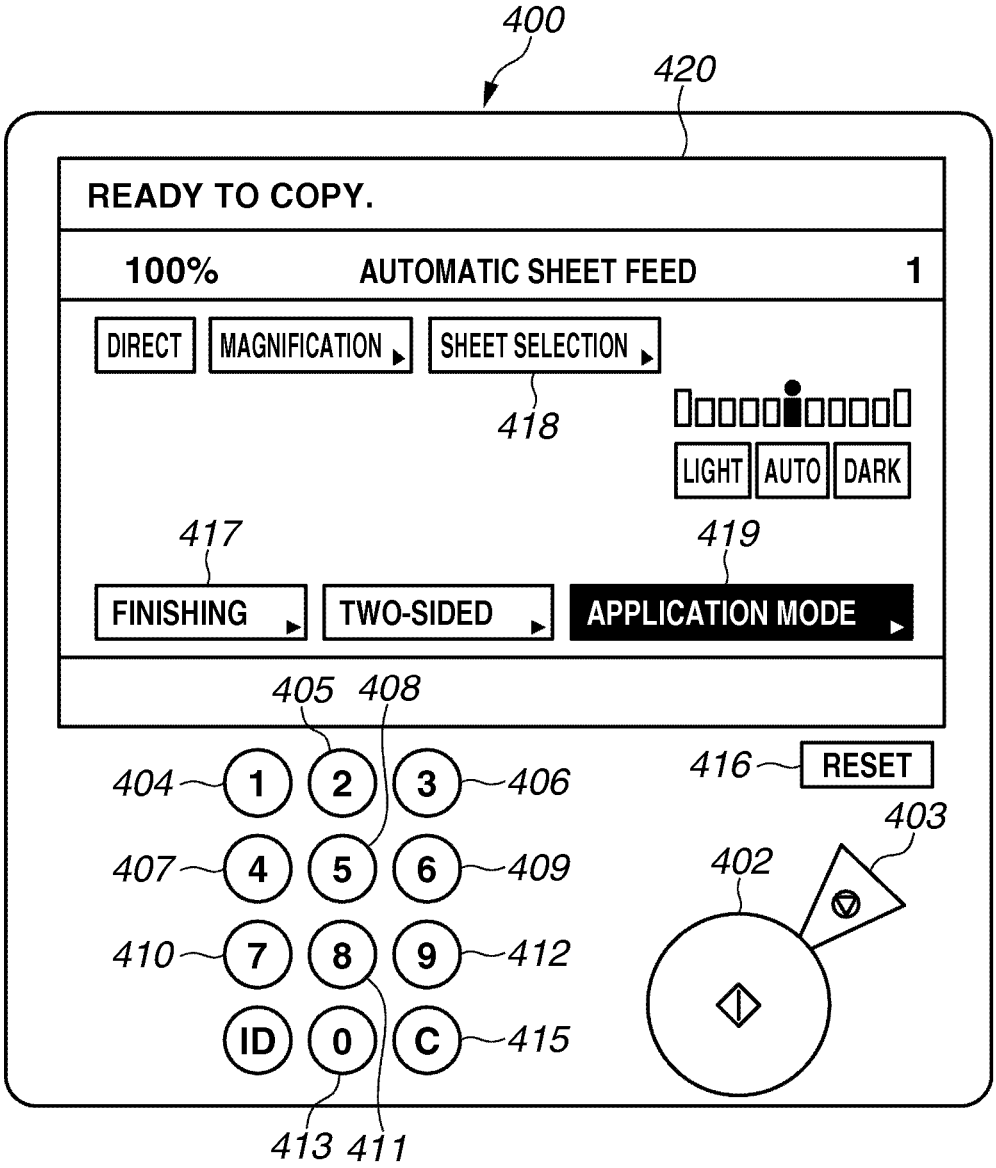
FIG. 3 illustrates an operation display unit.

FIG. 3 illustrates the operation display device 400 in the image forming apparatus in FIG. 1. Arranged on the operation display device 400 are a start key 402 for starting image forming operation, a stop key 403 for interrupting the image forming operation, numeric keys 404 through 413 for numerical setting, a clear key 415, a reset key 416, and the like. Further, there is arranged a display unit 420 on whose surface a touch panel is formed, making it possible to form soft keys on the screen.

As post-processing modes, the present image forming apparatus has various processing modes, such as a non-sort mode, a sort mode, a shift sort mode, and a staple sort mode (a binding mode). The setting of such processing modes and the like is performed through an input operation from the operation display device 400. For example, when a post-processing mode is set, the "finishing" key 417 is selected on the initial screen illustrated in FIG. 3. Then, a menu selection screen is displayed on the display unit 420, and the setting of the processing mode can be performed by the selection screen.

Figure 4A:
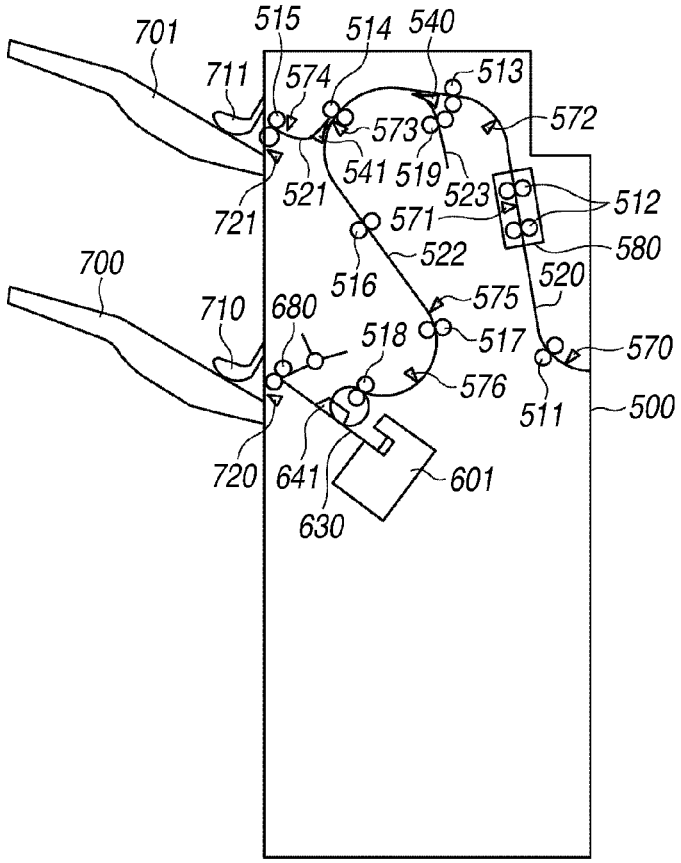
FIGS. 4A and 4B are sectional view of a finisher.
Figure 4B:
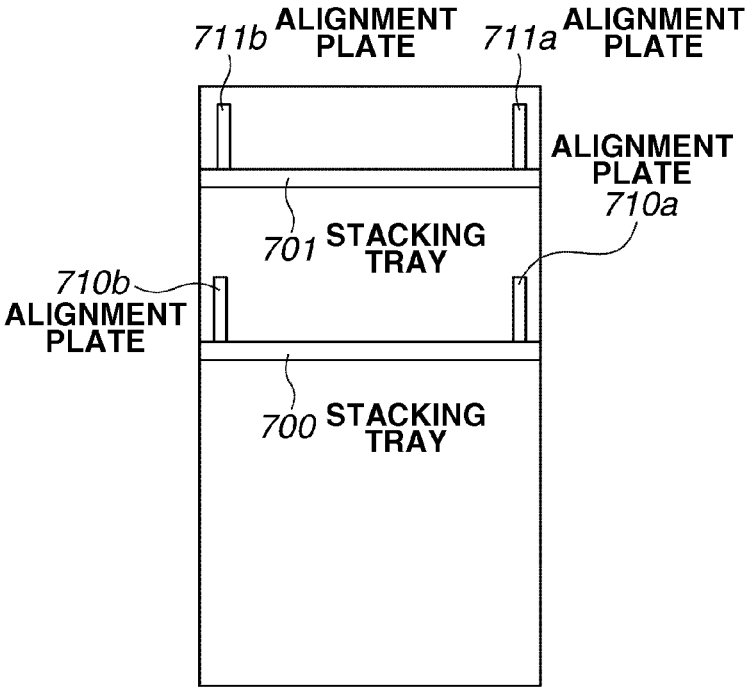

The configuration of the finisher 500 is described with reference to FIGS. 4A and 4B. FIGS. 4A and 4B are schematic diagrams illustrating the configuration of the finisher 500 in FIG. 1. FIG. 4A is a front view of the finisher 500, and FIG. 4B illustrates a stacking tray 701 included in the finisher 500 as seen from the sheet discharge side.

The finisher 500 performs various types of sheet post-processing, such as the processing for successively taking in the sheets discharged from the image forming apparatus 10 and aligning and binding a plurality of the sheets into a single bundle, and the stapling in which the trailing edge of the sheet bundle is stitched by the staple. The finisher 500 takes the sheets discharged from the image forming apparatus 10 into a conveyance path 520 by a conveyance roller pair 511. The sheet taken in by the conveyance roller pair 511 is conveyed via conveyance roller pairs 512, 513, and 514. Conveyance sensors 570, 571, 572, and 573 are provided in the conveyance path 520, each detecting the passage of a sheet. The conveyance roller pair 512 is provided in a shift unit 580 together with the conveyance path sensor 571.

The shift unit 580 can move the sheet in a sheet width direction, which is orthogonal to the conveyance direction, by a shift motor M5 described below. If the shift motor M5 is driven when the conveyance roller pair 512 pinches the sheet, the sheet can be offset in the width direction while being conveyed. In the shift sort mode, the position of the sheet bundle is shifted in the width direction for each copy. The offset amount is 15 mm on the front side (front shift) or 15 mm on the back side (back shift) with respect to the central position in the width direction. When there is no shift designation, the sheet is discharged to the same position as in the case of the front shift. When it is detected through the input of the conveyance sensor 571 that the sheet has passed the shift unit 580, the finisher 500 drives the shift motor M5, and restores the shift unit 580 to the center position.

Between the conveyance roller pairs 513 and 514, there is arranged a switching flapper 540 configured to guide the sheet, which is reversely conveyed by the conveyance roller pair 514, to a buffer path 523. The switching flapper 540 is driven by a solenoid SL1 described below. Between the conveyance roller pairs 514 and 515, there is arranged a switching flapper 541 configured to switch a conveyance path between an upper sheet discharge path 521 and a lower sheet discharge path 522. The switching flapper 541 is driven by the solenoid SL1 described below.

When the switching flapper 541 is switched to the upper sheet discharge path 521 side, the sheet is guided to the upper sheet discharge path 521 by the conveyance roller pair 514 driven by a buffer motor M2, and is discharged onto the stacking tray 701 by the conveyance roller pair 515 driven by a sheet discharge motor M3. A conveyance sensor 574 is provided on the upper sheet discharge path 521, and serves to detect the passage of a sheet. When the switching flapper 541 is switched to the lower sheet discharge path 522 side, the sheet is guided to the lower sheet discharge path 522 by the conveyance roller pair 514 driven by the buffer motor M2. The sheet is further guided to a processing tray 630 by conveyance roller pairs 517 and 518 driven by the sheet discharge motor M3. Conveyance sensors 575 and 576 are provided in the lower sheet discharge path 522, and serves to detect the passage of the sheet.

The sheet guided to the processing tray 630 is discharged onto the processing tray 630 or a stacking tray 700 according to the post-processing mode by a bundle discharge roller pair 680 driven by a bundle discharge motor M4.

In addition, as illustrated in FIG. 4B, there are arranged alignment plates 711*a* (first alignment member) and 711*b* (second alignment member) on the stacking tray 701. The alignment plates 711*a* and 711*b* serves as alignment members for aligning the positions in the sheet width direction of the sheets discharged onto the stacking tray 711. Similarly, as illustrated in FIG. 4B, there are arranged alignment plates 710*a* and 710*b* on the stacking tray 700. The alignment plates 710*a* and 710*b* align the positions in the width direction of the sheets discharged onto the stacking tray on the stacking tray 700.

Figure 6A:
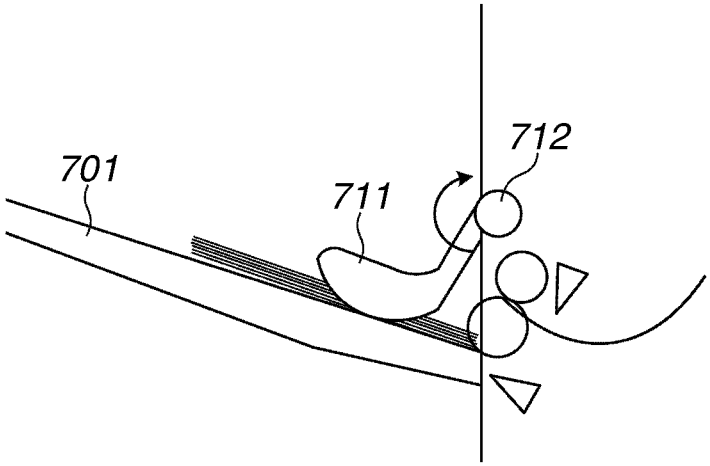
FIGS. 6A and 6B illustrate positions of a stacking tray and an alignment plate.
Figure 6B:
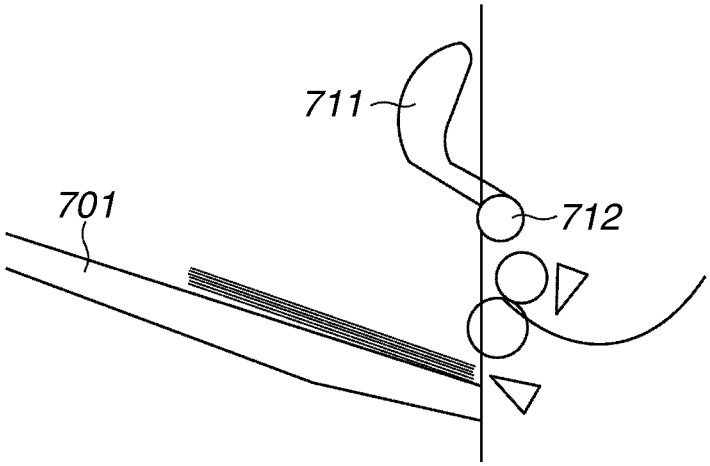

The alignment plates 710*a* and 710*b* can be moved in the sheet width direction by lower tray alignments motors M11 and M12 described below, respectively. The alignment plate 710*a* is arranged on the front side, and the alignment plate 710*b* is arranged on the back side. The alignment plates 711*a* and 711*b* are respectively driven by upper tray alignment motors M9 and M10 described below in a similar fashion. The alignment plate 711*a* is arranged on the front side, and the alignment plate 711*b* is arranged on the back side. Further, the alignment plates 710 and 711 are respectively vertically moved around an alignment plate shaft 712 between an alignment position (FIG. 6A) and a retracted position (FIG. 6B) by an upper tray alignment plate elevating motor M13 and a lower tray alignment plate elevating motor M14.

The stacking trays 700 and 701 are raised and lowered by tray elevating motors M15 and M16 described below. The tray surface or the surface of the uppermost sheet on the tray is detected by sheet surface detection sensors 720 and 721 described below. By driving the tray elevating motors M14 and M15 according to the input from the sheet surface detection sensors 720 and 721, the finisher 500 effects control such that the tray surface or the uppermost sheet surface on the tray is always at a fixed position. Further, the stacking trays 700 and 701 detect the presence of sheets on the stacking trays 700 and 701 by sheet presence detection sensors 730 and 731.

Figure 5:
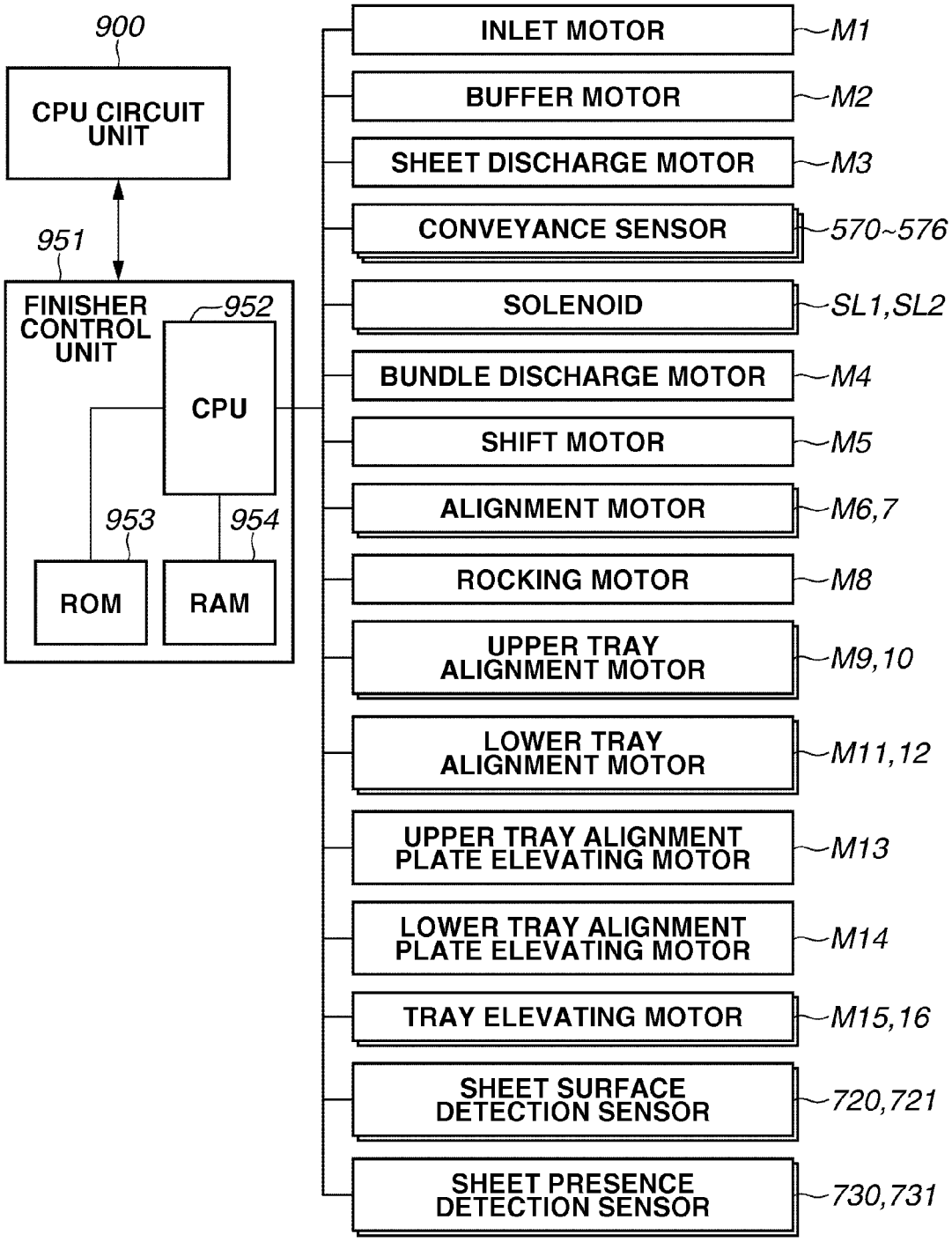
FIG. 5 is a block diagram illustrating a configuration of the finisher.

A configuration of a finisher control unit 951 configured to control the drive of the finisher 500 is described with reference to FIG. 5. FIG. 5 is a block diagram illustrating the configuration of the finisher control unit 951 in FIG. 2.

As illustrated in FIG. 5, the finisher control unit 951 includes a CPU 952, a ROM 953, a RAM 954, and the like. The finisher control unit 951 communicates with the CPU circuit unit 900 to perform data exchange, such as transmission and reception of commands, job information and sheet transfer notification, and executes various programs stored in the ROM 953 to control the drive of the finisher 500.

Various input and output functions that the finisher 500 includes is described. The finisher 500 is equipped with the inlet motor M1, the buffer motor 522, the sheet discharge motor M3, the shift motor M5, the solenoids SL1 and SL2, and the conveyance sensors 570 through 576 for driving the conveyance roller pairs 511 through 513 for the conveyance of sheets. Further, as the units for driving the various members of the processing tray 630, the finisher 500 is equipped with the bundle discharge motor M4 for driving the bundle discharge roller 680, alignment motors M6 and M7 for driving an alignment member 641, and a rocking guide motor M8 for elevating a rocking guide.

Further, the finisher 500 is equipped with the tray elevating motors M15 and M16 for elevating the stacking trays 700 and 701, the sheet surface detection sensors 720 and 721, and the sheet presence detection sensors 730 and 731. Furthermore, the finisher 500 is equipped with the upper tray alignment motors M9 and M10 and the lower tray alignment motors M11 and M12 for the alignment operation on the stacking trays, the upper tray alignment plate elevating motor M13, and the lower tray alignment plate elevating motor M14.

First, the sheet flow in the sort mode is described with reference to FIGS. 3, 7, 8A to 8D, 10A to 10C, and 11. When a user presses a "sheet selection" key 418 on the initial screen illustrated in FIG. 3 on the operation display device 400 of the image forming apparatus 10, a sheet feeding cassette selection screen as illustrated in FIG. 11 is displayed on the display unit 420. The user selects the sheet to be used for the job. In this case, the "A4" size is selected.

Figure 10A:
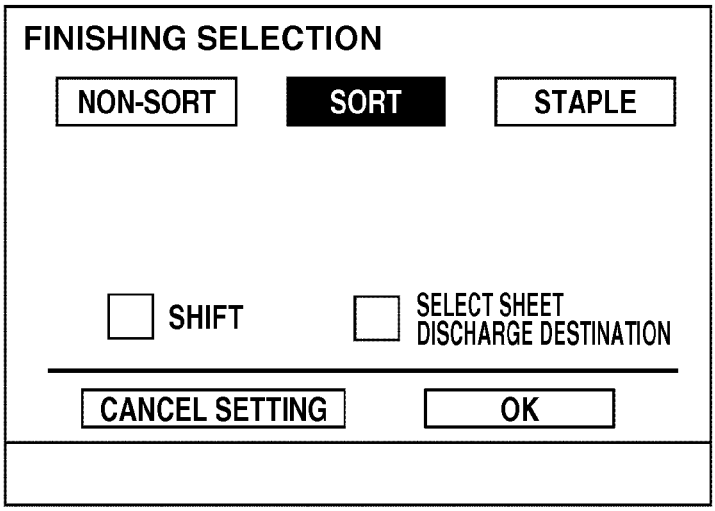
FIGS. 10A through 10C illustrate a finishing mode selection screen.
Figure 10B:
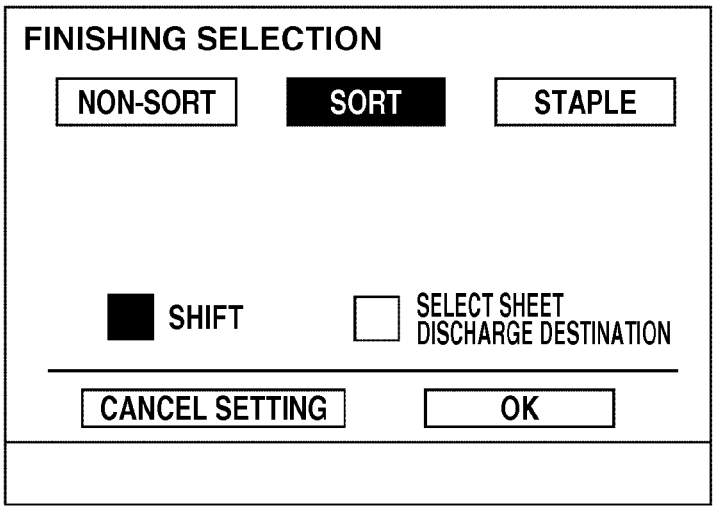
Figure 11:
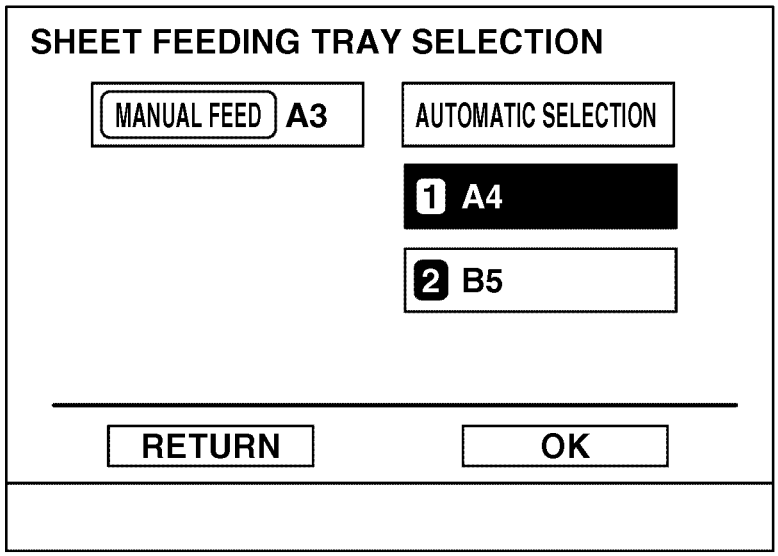
FIG. 11 illustrates a sheet feeding tray selection screen.

When the user selects a "finishing" key 417 on the initial screen illustrated in FIG. 3 on the operation display device 400 of the image forming apparatus 10, a finishing menu selection screen as illustrated in FIG. 10A is displayed on the display unit 420. When the user presses an OK key in the state in which the user has selected a "sort" key in FIG. 10A, the sort mode is set. If the sheet bundle is offset for each set of copies, the user selects the "shift" key, and, in this state, presses the OK key. Then, the shift mode is set.

When the sort mode is designated by the user, and a job is input, the CPU 901 in the CPU circuit unit 900 notifies the CPU 952 in the finisher control unit 951 of information related to the job, such as the sheet size and the fact that the sort mode is selected. In the present exemplary embodiment, after the sheet is discharged in one print job, a shift operation is performed on the sheet of the next print job such that its discharge position differs from that of the sheet of the preceding job. Such a shift operation for each print job is referred to as an inter-job shift.

When a sheet P is discharged from the image forming apparatus 10 to the finisher 500, the CPU 901 in the CPU circuit unit 900 informs the CPU 952 in the finisher control unit 951 that the transfer of the sheet is to be started. Further, the CPU 901 informs the CPU 952 in the finisher control unit 951 of sheet information, such as sheet shift information and sheet width information.

When the start of the sheet transfer is informed, the CPU 952 drives the inlet motor M1, the buffer motor M2, and the sheet discharge motor M3. As a result, as illustrated in FIG. 7, the conveyance roller pairs 511, 512, 513, 514, and 515 are rotated, and the sheet P discharged from the image forming apparatus 10 is taken into the finisher 500 to be conveyed therein.

When the conveyance path sensor 571 detects the sheet, it means that the conveyance roller pair 512 pinches the sheet P, so that the CPU 952 moves the shift unit 580 by driving the shift motor M5 and offsets the sheets in the width direction. If the shift information included in the sheet information informed from the CPU 901 is "no shift designation," the sheets are collectively offset to the front side by 15 mm.

Figure 7:
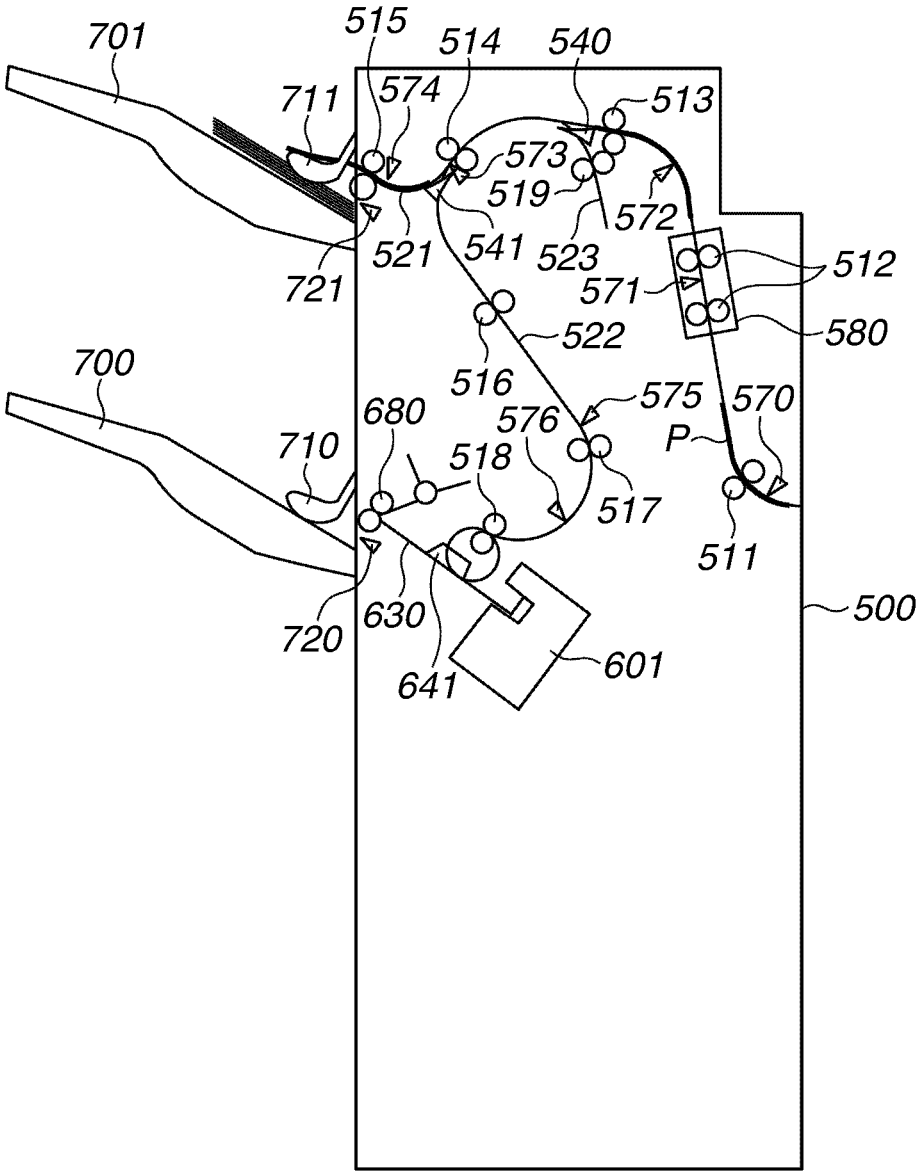
FIG. 7 illustrates sheet conveyance in the finisher.

When the switching flapper 541 is rotated to the position as illustrated in FIG. 7 by the solenoid SL1, the sheet P is guided to the upper sheet discharge path 521. When the passage of the trailing edge of the sheet P is detected by the conveyance sensor 574, the CPU 952 drives the sheet discharge motor M3 such that the conveyance roller pair 515 rotate at a speed suitable for the stacking, and the sheet P is discharged onto the stacking tray 701.

The alignment operation in the sort mode is described in relation to the front-side shift operation with reference to FIGS. 8A through 8D. FIGS. 8A through 8D illustrate the stacking tray 701 as seen from the sheet discharge side. The pair of alignment plates 711*a* and 711*b* stand by at the initial position illustrated in FIG. 8A prior to the start of a job.

Figure 8A:
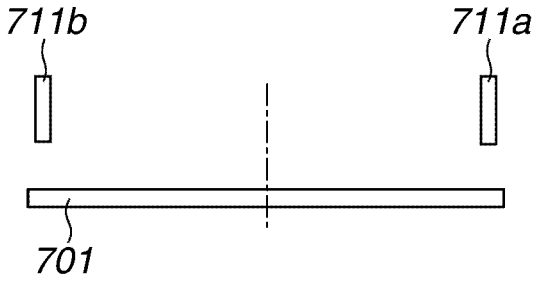
FIGS. 8A through 8D illustrate sheet alignment operations on the stacking tray when in a sort mode.
Figure 8B:
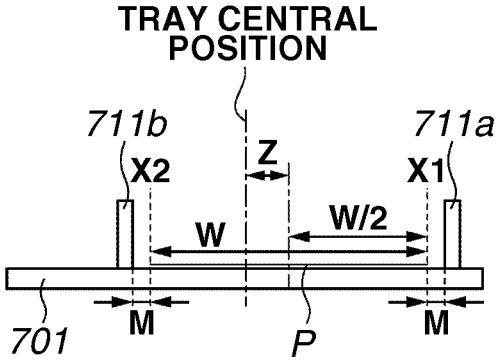

When the job is started, as illustrated in FIG. 8B, the front side alignment plate 711*a* moves from the central position of the stacking tray 701 to an alignment standby position, which is spaced away by a predetermined amount M from a front side sheet edge position X1, which is spaced away from the central position by a distance obtained by adding a shift amount Z to half the sheet width W/2. The alignment plate 711*a* remains standby at the alignment standby position until the sheet is discharged. The back side alignment plate 711*b* is on standby at an alignment standby position spaced away by the predetermined amount M from a back side sheet end position X2, which is spaced away from the central position of the stacking tray 701 by a distance obtained by subtracting the shift amount Z from half the sheet width W/2.

Figure 8C:
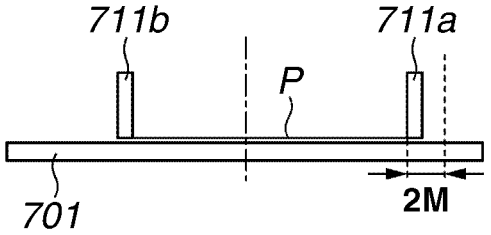
Figure 8D:
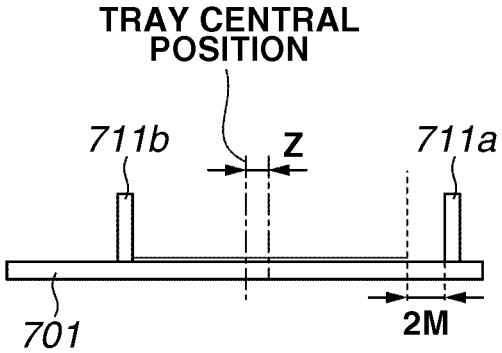

When a predetermined period of time has elapsed after the discharge of the sheet P onto the stacking tray 701, the front side alignment plate 711*a* moves toward the center of the stacking tray by a predetermined pushing-in amount 2M as illustrated in FIG. 8C, causing the sheet P to abut the back side alignment plate 711*b* at rest. As a result, the sheet P is shifted to the alignment plate 711*b* side by the predetermined amount M. When a predetermined period of time has elapsed after the abutment of the sheet P against the alignment plate 711*b*, the alignment plate 711*a* moves to the alignment standby position as illustrated in FIG. 8D. The alignment plate 711*a* moves in the sheet width direction away from the sheet P by twice the predetermined amount M, i.e., 2M, and remains on standby until the next sheet is discharged onto the stacking tray 701.

When the offset amount Z is 15 mm, and the predetermined amount M is 5 mm, the front side alignment plate 711*a* pushes in the sheet P by 5 mm at the time of alignment operation, so that the offset amount of the sheet after the alignment operation is 10 mm. The above-described operation is repeated, and the sheets are aligned each time a sheet is discharged onto the stacking tray.

Next, the sheet flow in the sheet sort mode is described with reference to FIGS. 3, 7, 9A to 9G, and 10A to 10C. When, the OK key is pressed with the "sort" key and the "shift" key selected on the finishing menu selection screen illustrated in FIG. 10B, the shift sort mode is set. When the shift sort mode is designated by the user, and a job is input, the CPU 901 in the CPU circuit unit 900 informs the CPU 952 in the finisher control unit 951 of the selection of the shift sort mode as in the case of the non-sort mode. In the following, the operation in the shift sort mode in a case where three sheets constitutes one set of the copy is described.

When the sheet P is discharged from the image forming apparatus 10 to the finisher 500, the CPU 901 in the CPU circuit unit 900 informs the CPU 952 in the finisher control unit 951 of the start of the sheet transfer.

When the start of the sheet transfer is informed, the CPU 952 drives the inlet motor M1, the buffer motor M2, and the sheet discharge motor M3. As a result, as illustrated in FIG. 7, the conveyance roller pairs 511, 512, 513, 514, and 515 are rotated, and the sheet P discharged from the image forming apparatus 10 is taken into the finisher 500 to be conveyed therein. When the conveyance path sensor 571 detects that the conveyance roller pair 512 has pinched the sheet P, the CPU 952 moves the shift unit 580 by driving the shift motor M5 to offset the sheet. When the sheet shift information notified from the CPU 901 indicates "the front side," the sheet is offset to the front side by 15 mm, and when the information indicates "the back side," the sheet is offset to the back side by 15 mm.

The switching flapper 541 is rotated to the position illustrated by the solenoid SL1, and the sheet P is guided to the upper sheet discharge path 521. When the conveyance sensor 574 detects the passage of the trailing edge of the sheet P, the CPU 952 drives the sheet discharge motor M3 such that the conveyance roller pair 515 rotates at a speed suitable for the stacking, and the sheet P is discharged onto the stacking tray 701.

The operation of the alignment plates at the time of shifting is described in relation to the case where the shifting direction is changed from the front to the back with reference to FIGS. 9A through 9G. FIGS. 9A through 9G illustrate the stacking tray 701 as seen from the sheet discharge side. As illustrated in FIG. 9A, when the moving operation of the front side alignment plate 711*a* is completed, the alignment plates 711*a* and 711*b* are spaced away vertically by a predetermined amount so as to be away from the stacking tray 701 as illustrated in FIG. 9B. Next, the alignment plates 711*a* and 711*b* move to the next sheet alignment standby position in the sheet width direction.

As illustrated in FIG. 9C, the front side alignment plate 711*a* moves from the central position of the stacking tray 701 to the alignment standby position spaced away by the predetermined amount M from the front side sheet end position X1 spaced away from the central position by a distance obtained by subtracting the shift amount Z from half the shift width W/2. The back side alignment plate 711*b* moves from the central position of the stacking tray 701 to the alignment standby position spaced away by the predetermined amount M from the back side sheet end position X2 spaced away from the central position by a distance obtained by adding the shift amount Z to half the sheet width W/2. When the movement to the alignment standby position is completed, the alignment plates 711*a* and 711*b* move vertically, as illustrated in FIG. 9D, by a predetermined amount toward the stacking tray 701, and remain on standby until the sheet is discharged onto the stacking tray 701. At this time, the alignment plate 711*a* is in contact with the upper surface of the already stacked sheet.

As illustrated in FIG. 9E, when a predetermined period of time has elapsed after the discharge of the sheet P onto the stacking tray 701, the alignment plate 711*b* moves toward the center of the stacking tray by the predetermined pushing-in amount 2M as illustrated in FIG. 9F, and causes the sheet P to abut the alignment plate 711*a*. When a predetermined period of time has elapsed in this state, the alignment plate 711*b* moves by the predetermined pushing-in amount 2M in the direction opposite to the stacking tray center as illustrated in FIG. 9G, and remains on standby until the next sheet is discharged onto the stacking tray 701.

As described above, when the shifting direction is changed, the finisher control unit 951 temporarily separates the alignment plates from the stacking tray in the upward direction, then lowers them after changing the alignment position, and performs sheet alignment each time a sheet is discharged onto the stacking tray.

Figure 10C:
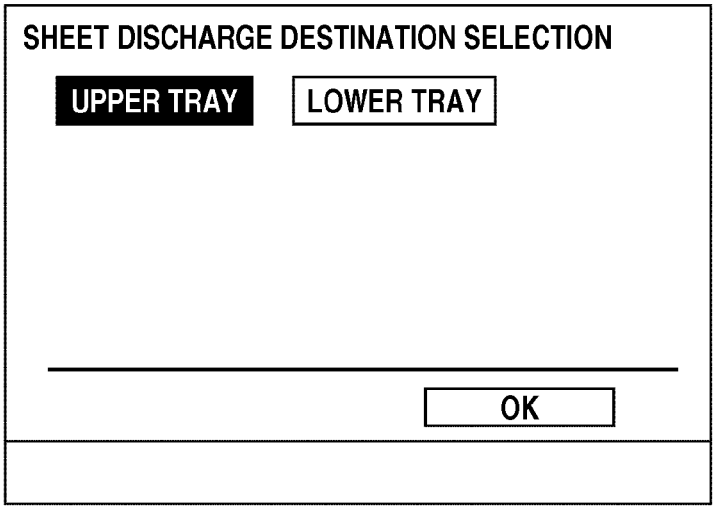

When the user selects a "discharge destination selection" key on the finishing menu selection screen illustrated in FIG. 10A, a sheet discharge destination selection screen as illustrated in FIG. 10C is displayed on the display unit 420. When the user selects a discharge destination and presses the OK key, the discharge destination is selected, and the finishing menu selection screen as illustrated in FIG. 10A is displayed on the display unit 420.

Different width mixed stacking, in which a plurality of sheets differing in width are stacked on the stacking tray, is described. When the user presses the "sheet selection" key 418 on the screen in FIG. 3, a sheet feeding tray selection screen as illustrated in FIG. 11 is displayed. When the user selects an "automatic selection" key, an automatic sheet selection mode is set. The automatic sheet selection mode is a mode in which a sheet of a size corresponding to the document size is automatically selected.

Figure 12A:
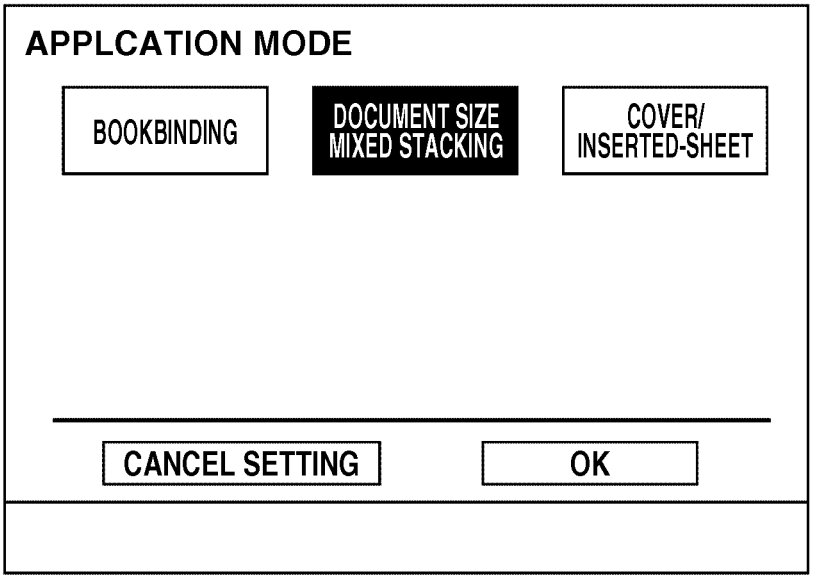
FIGS. 12A and 12B illustrate a document size mixed stacking mode setting screen.
Figure 12B:
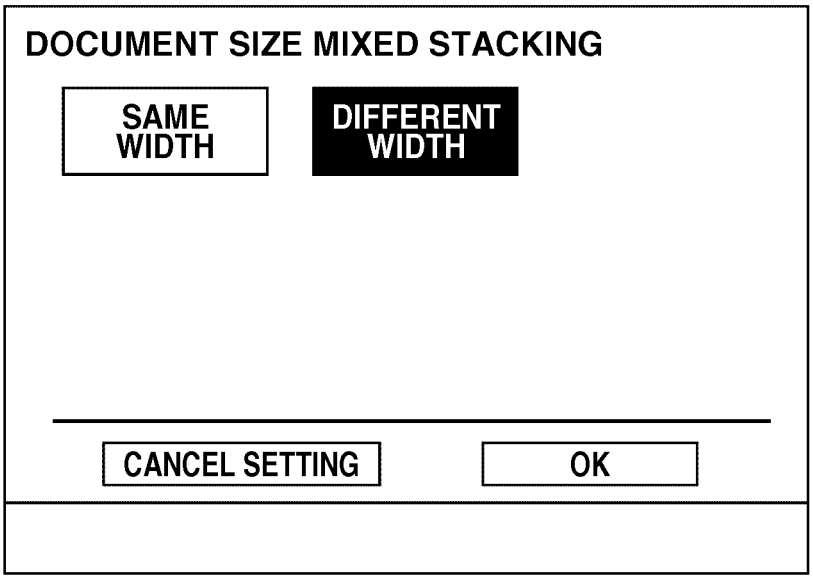

Next, when the user presses an "application mode" key 419, an application mode selection screen as illustrated in FIG. 12A is displayed. Next, when the user presses a "document size mixed stacking" key in FIG. 12A, a document size mixed stacking screen as illustrated in FIG. 12B is displayed. Next, when the user selects a "different width" key, and presses the OK button, a different width mixed mode is set. When the user presses the start key 402 in this state, a plurality of documents stacked on an automatic document feeder (ADF) 100 is fed one by one, and a sheet feeding tray accommodating sheets of the size corresponding to each document is automatically selected, and a sheet is fed. As a result, a plurality of sheets differing in width are stacked on the stacking tray.

In addition, not only in the case of the copying of a document image but also in the case of receiving and printing data prepared by a computer, if there exist pages of different image sizes, a plurality of sheets of different widths are stacked on the stacking tray.

While the above-described different width mixed stacking is involved in one print job, the different width mixed stacking described below is involved in two print jobs. When the user selects the "sheet selection" key 418 on the screen illustrated in FIG. 3, the sheet feeding tray selection screen as illustrated in FIG. 11 is displayed. Here, it is assumed that the user has selected the "A4" feeding tray. When image formation is executed in this state, an A4 size sheet is stacked on the stacking tray.

Next, it is supposed that the user has selected the "sheet selection" key 418 on the screen in FIG. 3, and the "B5" feeding tray on the screen illustrated in FIG. 11. When image formation is executed without changing the sheet discharge destination, a B5 size sheet is stacked on the A4 size sheet that has been stacked on the stacking tray in the preceding print job.

In addition, not only in the case of the copying of a document image but also in the case of the receiving and printing data prepared by a computer, if the sizes of the sheets used in the print jobs differ, a plurality of sheets of different widths are stacked on the stacking tray.

Figure 13:
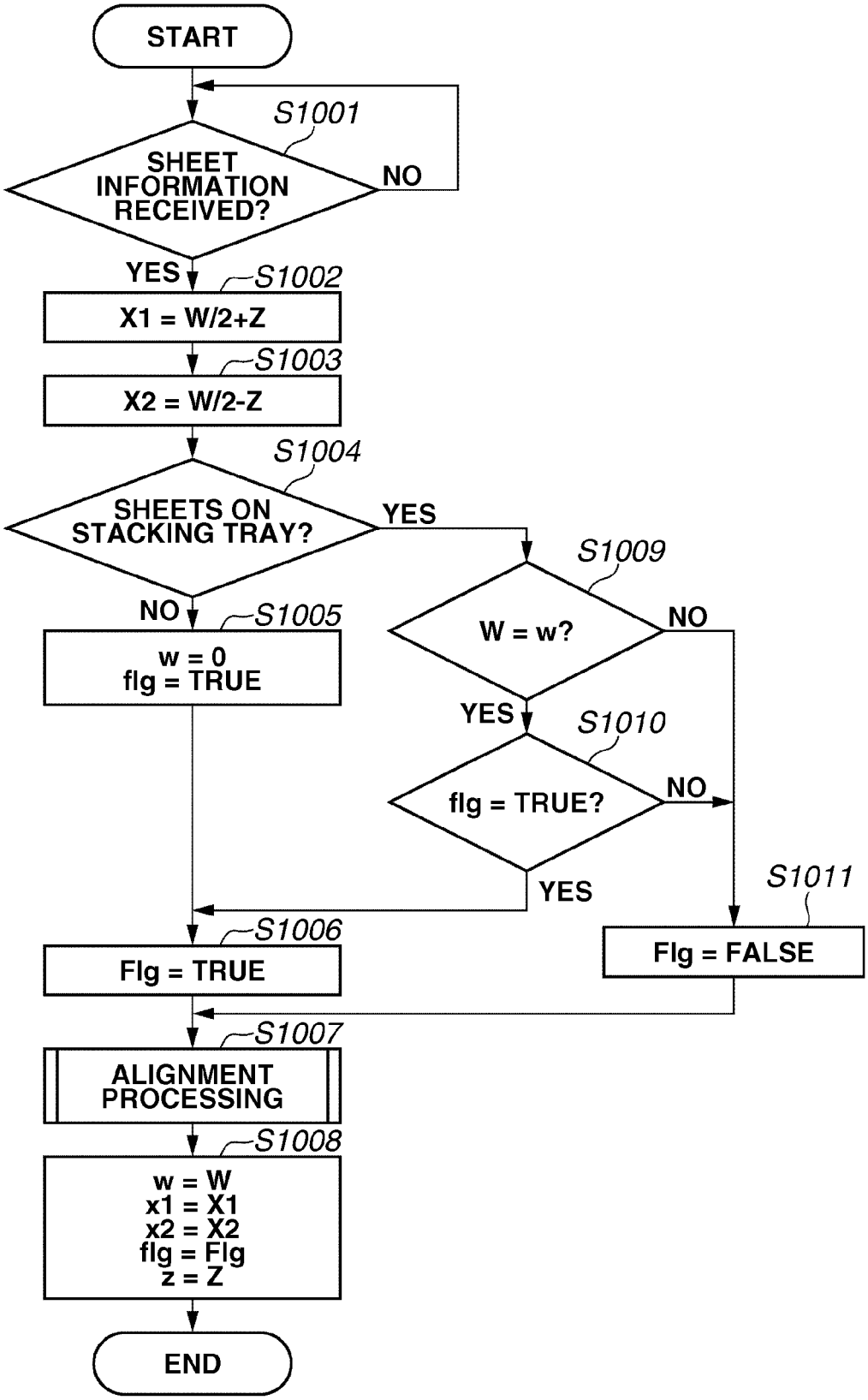
FIG. 13 is a flowchart illustrating a sheet discharge operation according to a first exemplary embodiment.

The sheet discharge operation executed by the CPU 952 in the finisher control unit 951 according to the first exemplary embodiment is described with reference to the flowchart in FIG. 13. In the following description, the sheet on which the CPU 952 is about to determine whether to perform alignment processing will be referred to as a target sheet. Regarding the sheet preceding to the target sheet (the preceding sheet), it has already been determined whether to perform alignment processing thereon.

In step S1001, the CPU 952 determines whether the sheet information is received from the CPU 901. The sheet information includes job information as to whether the sheet is the job first sheet or the job last sheet, a sheet width W, and an offset amount Z. Further, the information may be sheet information regarding a single job or sheet information covering a plurality of jobs. When the sheet information is received (YES in step S1001), the processing proceeds to step S1002, and when no sheet information is received (NO in step S1001), the processing in step S1001 is repeated again.

In step S1002, the CPU 952 calculates the front side sheet end position X1 illustrated in FIG. 8B from the following formula based on the sheet width W and the offset amount Z, and stores the calculated value in the RAM 954. Then, the processing proceeds to step S1003.

$$X1=W/2+Z$$

In step S1003, the CPU 952 calculates the back side sheet end position X2 illustrated in FIG. 8B from the following formula based on the sheet width W and the offset amount Z, and stores the calculated value in the RAM 954. Then, the processing proceeds to step S1004.

$$X2=W/2-Z$$

In step S1004, the CPU 952 determines, based on the inputs from the sheet presence detection sensors 730 and 731, whether there is a sheet on the stacking tray. When it determines that there is no sheet (NO in step S1004), the processing proceeds to step S1005, and when it determines that there is a sheet (YES in step S1004), the processing proceeds to step S1009.

In step S1005, the CPU 952 initializes to zero a variable w storing the width of the preceding sheet, which is a first sheet stored in the RAM 954, and sets to TRUE a variable flg storing whether alignment operation is performed on the preceding sheet. Then, the processing proceeds to step S1006.

In step S1006, the CPU 952 sets to TRUE a variable Flg storing whether alignment operation is performed on the target sheet, which is a second sheet, stored in the RAM 954. Then, the processing proceeds to step S1007.

In step S1007, the CPU 952 executes the alignment processing (FIG. 14) described below, and the processing proceeds to step S1008. In step S1007, the CPU 952 performs the alignment operation on a sheet for which the variable Flg is set to TRUE, and does not perform the alignment operation on a sheet for which the variable Flg is set to FALSE.

Figure 14:
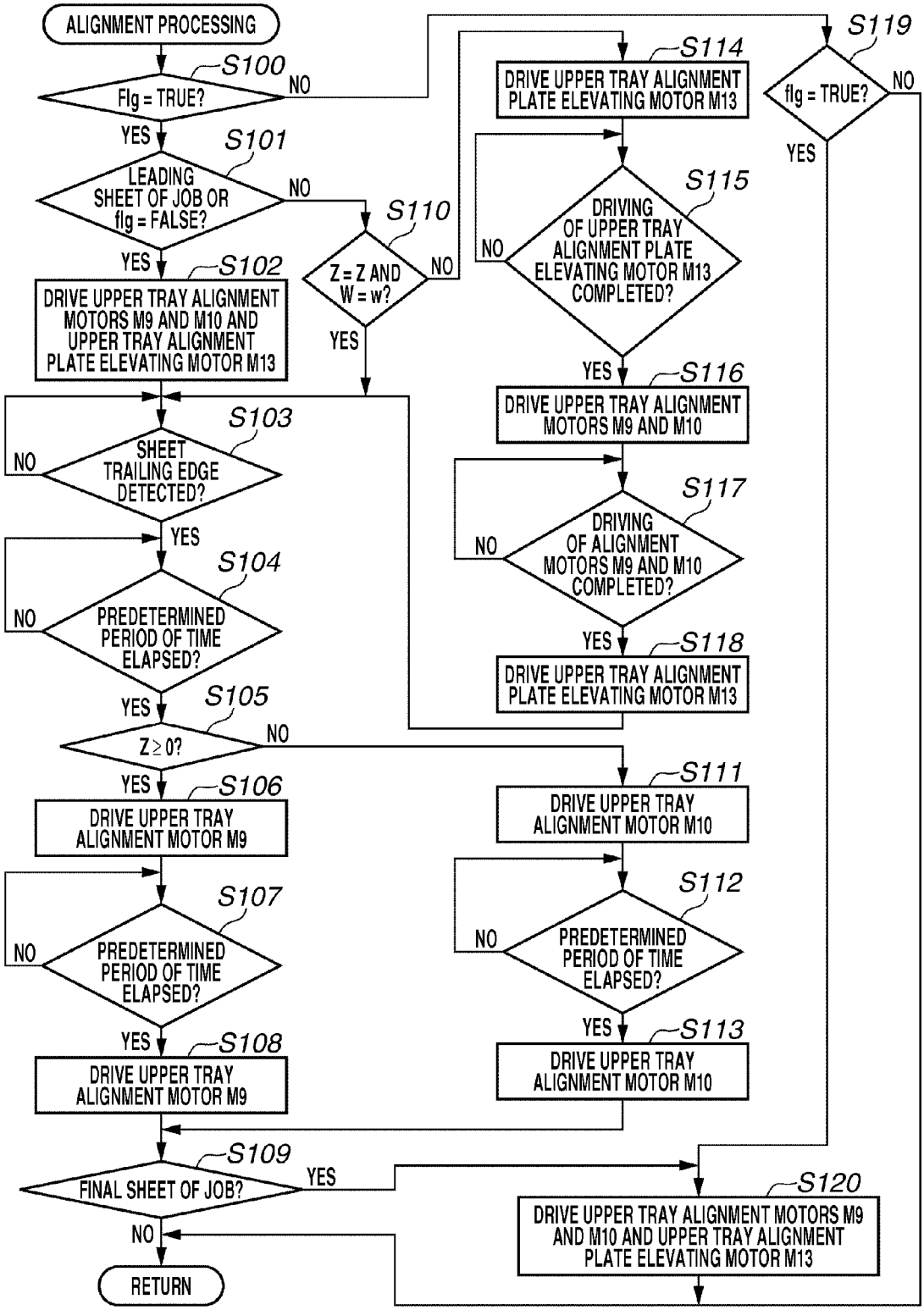
FIG. 14 is a flowchart illustrating an alignment processing operation.

The alignment processing is described with reference to the flowchart in FIG. 14. In step S100, the CPU 952 refers to a Flg value. If the variable Flg is set to TRUE (YES in step S100), the processing proceeds to step S101, and, if the variable Flg is set to FALSE (NO in step S100), the processing proceeds to step S119.

In step S101, the CPU 952 determines whether the target sheet is the first sheet of the print job based on the sheet information, or whether the preceding sheet is one on which the alignment operation is performed based on the flg value. If the target sheet is the first sheet of the job or if the variable flg is set to FALSE (YES in step S101), the processing proceeds to step S102. Otherwise, the processing proceeds to step S110.

In step S102, the CPU 952 drives the upper tray alignment motors M9 and M10 and the upper tray alignment plate elevating motor M13 so as to move the alignment plates 711 from the initial positions illustrated in FIG. 8A to the standby positions illustrated in FIG. 8B, Then, the processing proceeds to step S103.

In step S103, the CPU 952 determines whether the sheet trailing edge (OFF edge) is detected based on the output of the conveyance sensor 574. If the sheet trailing edge is detected (YES in step S103), the processing proceeds to step S104. If the sheet trailing edge is not detected (NO in step S103), the processing in step S103 is repeated again.

In step S104, the CPU 952 determines whether a predetermined period of time has elapsed since the detection of the sheet trailing edge. If the predetermined period of time has elapsed (YES in step S104), the processing proceeds to step S105, whereas, if the predetermined period of time has not elapsed (NO in step S104), the processing in step S104 is repeated again.

In step S105, the CPU 952 determines the sheet shifting direction from the offset amount Z included in the sheet information. When the offset amount Z is equal to or larger than zero (YES in step S105), it is determined that the front shift is to be effected, and the processing proceeds to step S106. Whereas, when the offset amount Z is less than zero (NO in step S105), it is determined that the back shift is to be effected, and the processing proceeds to step S111.

In step S106, the CPU 952 moves the alignment plate 711*a* toward the center of the stacking tray as illustrated in FIG. 8C, and drives the upper tray alignment motor M9 so as to cause the sheet P to abut the alignment plate 711*b* at rest to thereby perform the alignment operation. Then the processing proceeds to step S107.

In step S107, the CPU 952 determines whether a predetermined period of time has elapsed since the movement of the alignment plate 711*a*. If the predetermined period of time has elapsed (YES in step S107), the processing proceeds to step S108. If the predetermined period of time has not elapsed (NO in step S107), the processing in step S107 is repeated again.

In step S108, the CPU 952 drives the upper tray alignment motor M9 so as to move the alignment plate 711*a* in the sheet width direction away from the sheet P as illustrated in FIG. 8D. Then, the processing proceeds to step S109.

In step S109, the CPU 952 determines whether the target sheet is the final sheet of the job based on the sheet information. If the target sheet is the final sheet of the job (YES in step S109), the processing proceeds to step S120. Whereas, if the target sheet is not the final sheet of the job (NO in step S109), the alignment processing is completed, and the processing returns to step S1008 in the flowchart in FIG. 13.

In step S111, the CPU 952 moves the alignment plate 711*b* in the width direction toward the center of the stacking tray, and drives the upper tray alignment motor M10 so as to cause the sheet to abut the alignment plate 711*a* at rest. Then, the processing proceeds to step S112.

In step S112, the CPU 952 determines whether a predetermined period of time has elapsed since the movement of the alignment plate 711*b*. If the predetermined period of time has elapsed (YES in step S112), the processing proceeds to step S113. Whereas, if the predetermined period of time has not elapsed (NO in step S112), the processing in step S112 is repeated again.

In step S113, the CPU 952 drives the upper tray alignment motor M10 so as to move the alignment plate 711*b* in a direction away from the sheet P in the sheet width direction, and the processing proceeds to step S109.

In step S110, the CPU 952 compares the offset amount Z of the target sheet and the offset amount z of the preceding sheet, and compares the sheet width W of the target sheet and the sheet width w of the preceding sheet. When the offset amount Z is equal to the offset amount z and the sheet width W is equal to the sheet width w (YES in step S110), the target sheet is stacked at the same position as the preceding sheet, so that the processing proceeds to step S103. Otherwise, the processing proceeds to step S114 to change the standby positions of the alignment plates 711.

In step S114, the CPU 952 drives the upper tray alignment plate elevating motor M13 so as to cause the alignment plates 711*a* and 711*b* to be spaced away from the stacking tray 701 by a predetermined amount as illustrated in FIG. 9B. Then, the processing proceeds to step S115.

In step S115, the CPU 952 determines whether the driving of the upper tray alignment plate elevating motor M13 is completed. If the driving is completed (YES in step S115), the processing proceeds to step S116. Otherwise (NO in step S115), the processing in step S115 is repeated again.

In step S116, the CPU 952 drives the upper tray alignment motors M9 and M10 so as to move the alignment plates 711*a* and 711*b* in the sheet width direction to the alignment standby positions for the next sheet. Then, the processing proceeds to step S117.

In step S117, the CPU 952 determines whether the driving of the upper tray alignment motors M9 and M10 is completed. If the driving is completed (YES in step S117), the processing proceeds to step S118. Otherwise (NO in step S117), the processing in step S117 is repeated again.

In step S118, the CPU 952 drives the upper tray alignment plate elevating motor M13 so as to move the alignment plates 711*a* and 711*b* toward the stacking tray 701 by a predetermined amount as illustrated in FIG. 9D. Then, the processing proceeds to step S103.

In step S119, the CPU 952 determines, based on a setting of the variable flg, whether the preceding sheet is subjected to the alignment operation. If the preceding sheet is subjected to the alignment operation, in other words, if the variable flg is set to TRUE (YES in step S119), the processing proceeds to step S120. Otherwise (NO in step S119), the alignment processing is completed.

In step S120, the CPU 952 drives the upper tray alignment motors M9 and M10 and the upper tray alignment plate elevating motor M13 so as to move the alignment plates 711*a* and 711*b* to the initial positions illustrated in FIG. 8A. Then, the alignment processing is completed.

While in the present exemplary embodiment described above the sheet is discharged onto the stacking tray 701, a similar operation is also performed when the sheet is discharged onto the stacking tray 700. In this case, the CPU 952 detects the sheet trailing edge based on the output of the conveyance sensor 576, and drives the lower tray alignment motors M11 and M12 and the lower tray alignment plate elevating motor M14 to perform the alignment operation.

Referring back to FIG. 13, in step S1008, the CPU 952 substitutes the sheet width W of the target sheet for w, substitutes the front side sheet edge position X1 for x1, substitutes the back side sheet end position X2 for x2, substitutes the variable Flg for flg, and substitutes the variable Z for z, then the processing is completed.

In step S1009, the CPU 952 determines whether the sheet width W of the target sheet is equal to the sheet width w of the preceding sheet. If the sheet widths are equal to each other (YES in step S1009), the processing proceeds to step S1010. Otherwise (NO in step S1009), the processing proceeds to step S1011.

In step S1010, the CPU 952 determines, based on the setting of the variable flg, whether the preceding sheet is subjected to the alignment operation. If the variable flg is set to TRUE (i.e., when the alignment operation is performed, YES in step S1010), the processing proceeds to step S1006. If the variable flg is set to FALSE (i.e., when no alignment operation is performed, NO in step S1010), the processing proceeds to step S1011.

In step S1011, the CPU 952 sets the variable Flg to FALSE so as not to perform any alignment operation on the target sheet, and the processing proceeds to step S1007.

For example, it is supposed that the "upper tray" (the stacking tray 701) is selected as the discharge destination, the size of the first, second, and fifth sheets is set to "A4," and the size of the third and fourth sheets is set to "B5," with there is no sheets on the stacking tray 701. In this case, with respect to the first and second sheets, the variable Flg is set to TRUE, so that the alignment operation is performed thereon, whereas, with respect to the third, fourth, and fifth sheets, the variable Flg is set to FALSE, so that no alignment operation is performed thereon. In this way, when a sheet of a sheet width different from that of a sheet already stacked on the stacking tray is stacked thereon, as in the case of stacking a B5 size sheet on an A4 size sheet, no alignment operation is performed. Accordingly, there is no fear of the alignment plate being rubbed against the already stacked sheet, so that the quality of the already stacked sheet can be prevented from deteriorating.

The reason for prohibiting an uniform alignment operation in the case where a sheet of a sheet width different from that of a sheet already stacked on the stacking tray is stacked thereon, is to facilitate the control.

Figure 15:
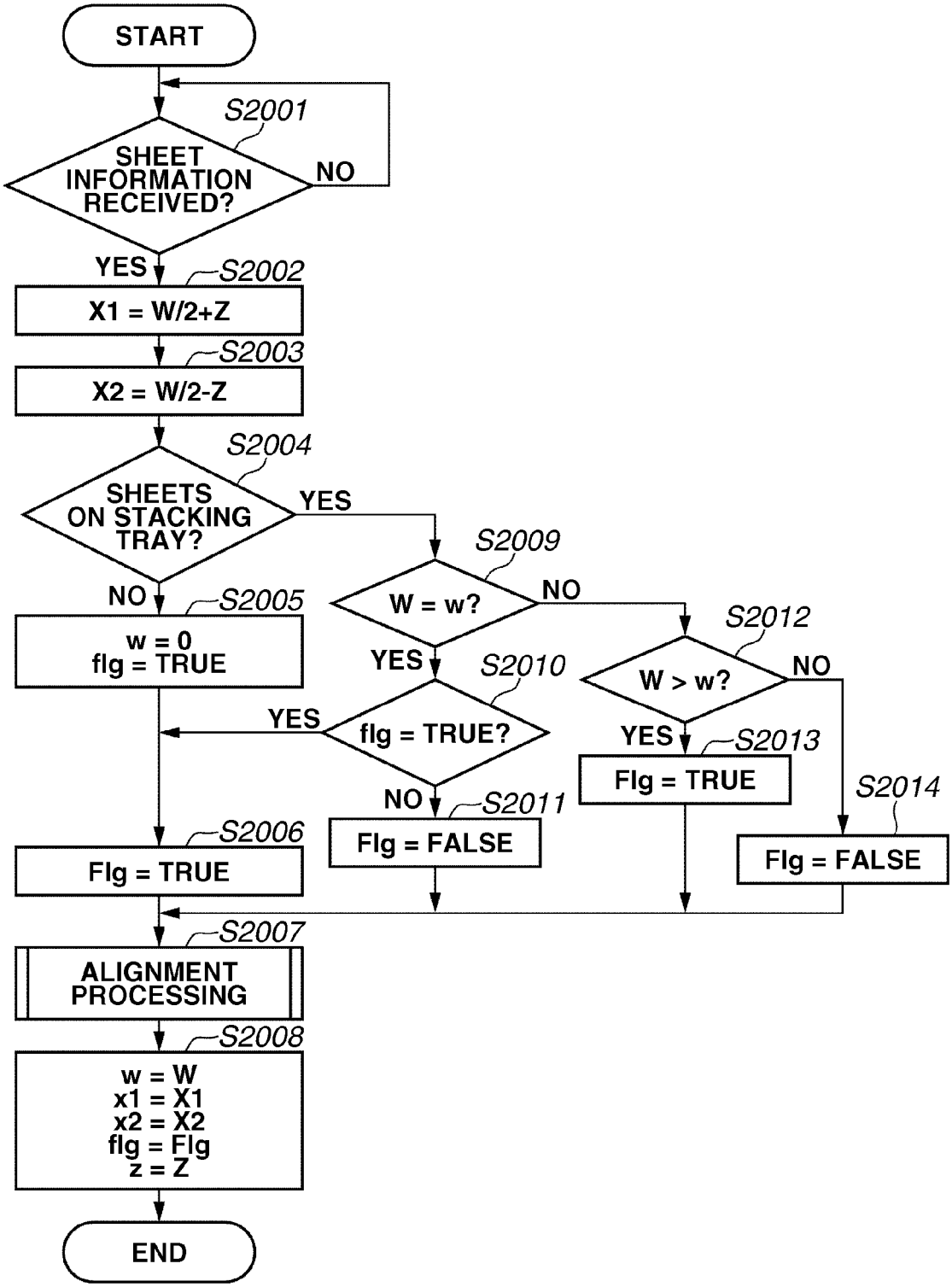
FIG. 15 is a flowchart illustrating a sheet discharge operation according to a second exemplary embodiment.

A sheet discharge operation executed by the CPU 952 in the finisher control unit 951 according to a second exemplary embodiment is described with reference to the flowchart in FIG. 15. In the first exemplary embodiment illustrated in FIG. 13, no uniform alignment operation is performed on the target sheet when the sheet width of the target sheet is different from the sheet width of the preceding sheet in step S1009.

The second exemplary embodiment differs from the first exemplary embodiment in that the alignment operation is performed on the target sheet when the width of the sheet to be discharged is larger than that of the preceding sheet. In the flowchart in FIG. 15, the processing in steps S2001 to S2011 are the same as those in steps S1001 to S1011 in the flowchart in FIG. 13, so the description thereof is omitted.

When, in step S2009, the sheet width W of the target sheet differs from the sheet width w of the preceding sheet (NO in step S2009), the processing proceeds to step S2012. In step S2012, the CPU 952 determines whether the sheet width W of the target sheet is larger than the sheet width w of the preceding sheet. When the sheet width W of the target sheet is larger than the sheet width w of the preceding sheet (YES in step S2012), the processing proceeds to step S2013. Otherwise (NO in step S2012), the processing proceeds to step S2014.

In step S2013, the CPU 952 sets the variable Flg to TRUE so that the alignment operation is to be performed on the target sheet. Then, the processing proceeds to step S2007. On the other hand, in step S2014, the CPU 952 set the variable Flg to FALSE so that no alignment operation is to be performed on the target sheet. Then, the processing proceeds to step S2007. The subsequent operations are similar to those of the first exemplary embodiment.

For example, it is supposed that the "upper tray" (the stacking tray 701) is selected as the discharge destination, the size of the first, second, and fifth sheets is set to "A4," and the size of the third and fourth sheets is set to "B5," with there is no sheets on the stacking tray 701. With respect to the first, second, and fifth sheets, the variable Flg is set to TRUE, so that alignment operation is performed thereon. Whereas, with respect to the third and fourth sheets, the variable Flg is set to FALSE, so that no alignment operation is performed thereon. In this way, in the case where the sheet width of the sheet to be stacked on the already stacked sheet is smaller than that of the latter, as in the case of stacking a B5 size sheet on an A4 size sheet, no alignment operation is performed on the sheet of the smaller width. The alignment operation is performed on the sheet of the larger width. Thus, there is no fear of the alignment plate being rubbed against the already stacked sheet, so that the quality of the already stacked sheet can be prevented from deteriorating.

If the sheet width of the sheet to be stacked on the already stacked sheet is larger than that of the latter, as in the case of stacking an A4 size sheet on a B5 size sheet, the alignment operation is also performed on the sheet of the larger width. As a result, it is possible to continue the alignment operation without fear of the alignment plate being rubbed against the already stacked sheet, and an aligned product can be obtained in the case of a different width mixed stacking.

Figure 16:
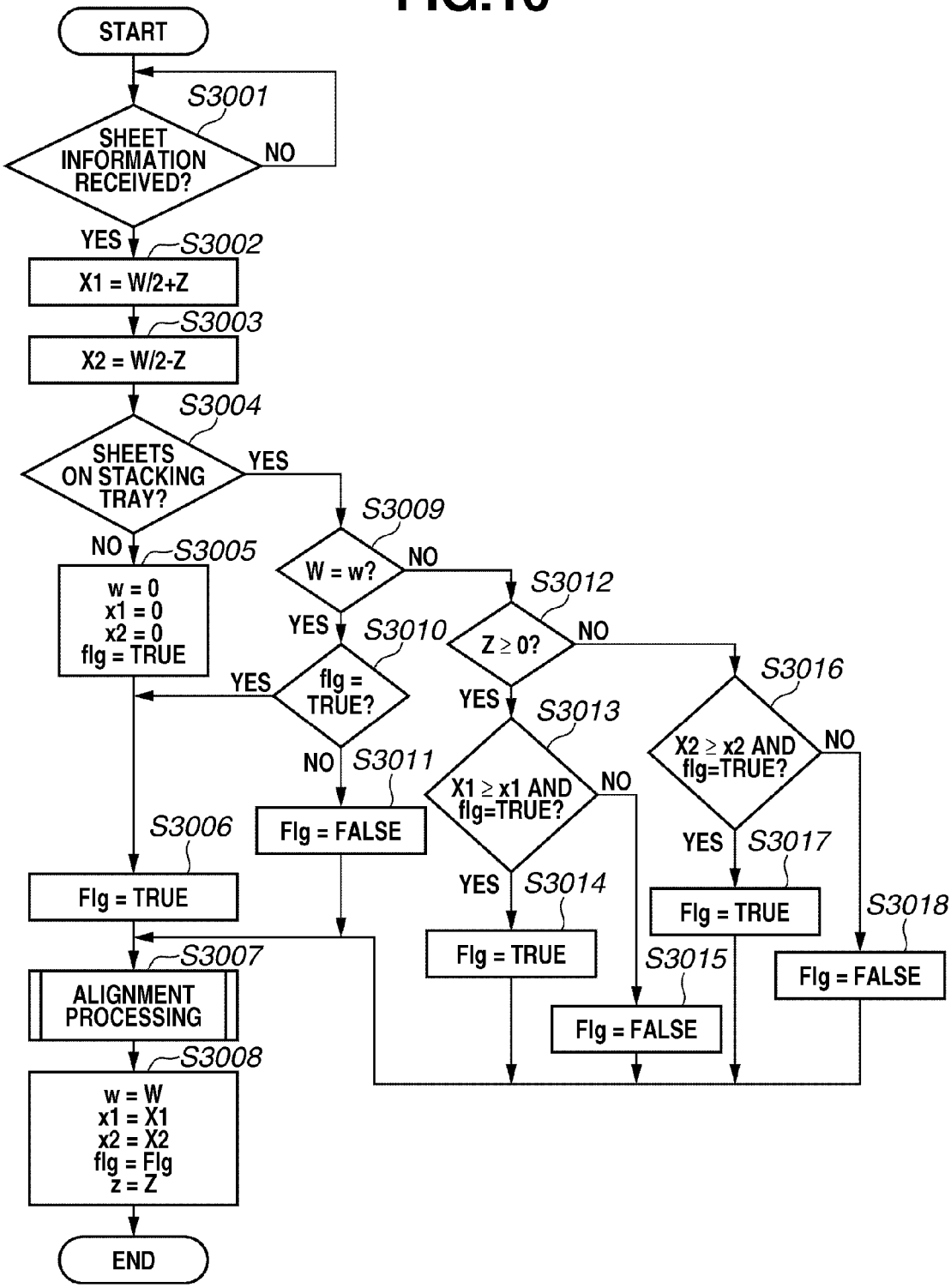
FIG. 16 is a flowchart illustrating a sheet discharge operation according to a third exemplary embodiment.
Figure 17:
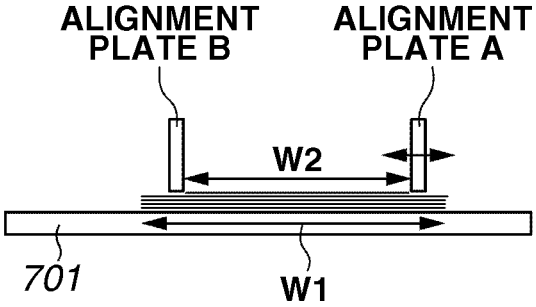
FIG. 17 illustrates an alignment operation when a plurality of sheets of different sheet widths are stacked together.

A sheet discharge operation executed by the CPU 952 in the finisher control unit 951 according to a third exemplary embodiment is described with reference to the flowchart in FIG. 16. In the first exemplary embodiment illustrated in FIG. 13, no uniform alignment operation is performed on the target sheet when the sheet width of the target sheet is different from the sheet width of the preceding sheet in step S1009.

The third exemplary embodiment differs from the first exemplary embodiment in that it is determined whether to perform the alignment operation on the target sheet taking into consideration the stacking position in the width direction of the preceding sheet and the offset direction of the target sheet. In the flowchart in FIG. 16, the processing in steps S3001 to S3004 and in steps S3006 to S3011 are the same as those in steps S1001 to S1004 and in steps S1006 to S1011 in the flowchart in FIG. 13, so the description thereof is omitted.

When, in step S3004, it is determined that there is no sheet on the stacking tray (NO in step S3004), the processing proceeds to step S3005. In step S3005, the CPU 952 initializes to zero the sheet width w of the preceding sheet, the front side sheet end position x1 of the preceding sheet, and the back side sheet end position x2 of the preceding sheet, respectively, and sets the variable flg to TRUE in the RAM 954. The subsequent operations are similar to those in the flowchart in FIG. 13.

In step S3009, if it is determined that the sheet width W of the target sheet differs from the sheet width w of the preceding sheet (NO in step S3009), then in step S3012, the CPU 952 determines whether the target sheet is set to the front shift or the back shift based on the value of the offset amount Z. When the offset amount Z is of a positive value (YES in step S3012), it is determined that the front shift is to be performed, and the processing proceeds to step S3013. When the offset amount Z is of a negative value (NO in step S3012), it is determined that the back shift is to be performed, and the processing proceeds to step S3016.

In step S3013, the CPU 952 determines, based on the setting of the variable flg, whether the preceding sheet is subjected to the alignment operation, and, at the same time, compares the front side sheet end position X1 at the time of stacking of the target sheet and the front side sheet end position x1 of the preceding sheet. When the front side sheet end position X1 is equal to or larger than the front side sheet end position x1, even if the alignment processing is performed, the alignment plate 711*a* does not move on the already stacked preceding sheet. On the other hand, when the front side sheet end position X1 is smaller than the front side sheet end position x1, if the alignment processing is performed, the alignment plate 711*a* will move on the preceding sheet. Thus, when the front side sheet end position X1 is equal to or larger than the front side sheet end position x1, and the variable flg is set to TRUE (YES in step S3013), the processing proceeds to step S3014. Otherwise (NO in step S3013), the processing proceeds to step S3015.

In step S3014, the CPU 952 sets the variable Flg to TRUE. The processing in the subsequent steps are similar to those of the first exemplary embodiment. On the other hand, in step S3015, the CPU 952 sets the variable Flg to FALSE. The processing is similar to that in the first exemplary embodiment.

In step S3016, the CPU 952 determines, based on the setting of the variable flg, whether the preceding sheet is subjected to the alignment operation, and, at the same time, compares the back side sheet end position X2 at the time of stacking of the target sheet and the back side sheet end position x2 of the preceding sheet. When the back side sheet end position X2 is not on the inner side of the back side sheet end position x2 (nearer to the center), if the alignment processing is performed, the alignment plate 711*b* does not move on the already stacked preceding sheet. On the other hand, if the back side sheet end position X2 is on the inner side of the back side sheet end position x2, if the alignment processing is performed, the alignment plate 711*b* will move on the preceding sheet. Thus, if the back side sheet end position X2 is not on the inner side of the back side sheet end position x2 and the variable flg is set to TRUE (YES in step S3016), the processing proceeds to step S3017. Otherwise (NO in step S3016), the processing proceeds to step S3018.

In step S3017, the CPU 952 sets the variable Flg to TRUE. The processing in the subsequent steps are similar to those of the first exemplary embodiment. On the other hand, in step S3018, the CPU 952 sets the variable Flg to FALSE. The processing in the subsequent steps are similar to those of the first exemplary embodiment.

For example, it is supposed that the "upper tray" (stacking tray 701) is selected as the discharge destination, and the sheet size of the first job is set to "A4," and the sheet size of the second job to "LETTER." Further, it is supposed that there is no sheet on the stacking tray 701. In this case, the sheet of the first job differs from the sheet of the second job in the shifting direction. Assuming that the sheet of the first job undergoes the front shift, the sheet of the second job undergoes the back shift. In this case, at the time of alignment of the A4 size sheet of the first job, the alignment plate 711*a* on the front side moves.

At the time of alignment of the LETTER size sheet of the second job, the alignment plate 711*b* on the back side moves. The backside sheet end position of the LETTER size sheet which is offset and discharged is at a position farther from the stacking tray center than the back side sheet end position of the A4 size sheet. In other words, the positions of both ends in the width direction of the sheet of the second job are not situated on the inner side of the positions of both ends of the sheet of the first job, so that the variable Flg is set to TRUE with respect to the sheet of the first job and of the second job. As a result, the alignment operation is also possible on the sheet of the second job. In other words, when a sheet of a smaller sheet width than the already stacked sheet is to be stacked thereon, it is possible to perform the alignment operation thereon.

Further, for example, it is supposed that the "upper tray" (stacking tray 701) is selected as the discharge destination, and the sheet size of the first job is set to "A4," and the sheet size of the second job to "B5." Further, it is supposed that there is no sheet on the stacking tray 701. In this case, even if the sheet of the first job undergoes the front shift and the sheet of the second job undergoes the back shift, the positions of both side ends of the sheet of the second job are situated on the inner side of both side end positions of the sheet of the first job. Accordingly, the alignment operation on the sheet of the second job is prohibited.

Thus, there is no fear of the alignment plate being rubbed against the already stacked sheet, so that the quality of the already stacked sheet can be prevented from deteriorating.

The present invention can be applied to a system which allows a user to select one of the discharge operations according to the first through third exemplary embodiments described above.

While the present invention has been described with reference to exemplary embodiments, it is to be understood that the invention is not limited to the disclosed exemplary embodiments. Each feature disclosed in the description, and (where appropriate) the claims and drawings may be provided independently or in any appropriate combination.

This application claims priority from Japanese Patent Application No. 2011-171106 filed Aug. 4, 2011, which is hereby incorporated by reference herein in its entirety.

What is claimed is:

1. A sheet stacking apparatus comprising:

a discharge unit configured to discharge a sheet;

a stacking tray on which the sheet to be discharged by the discharge unit is stacked;

an alignment unit configured to align the sheet stacked on the stacking tray in a width direction which is orthogonal to a direction in which the sheet is discharged, wherein the alignment unit includes first and second alignment members configured to move in the width direction and to come into contact with side ends in the width direction of the sheet stacked on the stacking tray to align the sheet, and wherein one of the first and second alignment members is placed on a first sheet in a case where a subsequent second sheet to be shifted in the width direction and stacked on the first sheet stacked on the stacking tray is aligned; and a control unit configured to prohibit, if a length of the second sheet in the width direction is different from a length of the first sheet in a case where the second sheet is shifted in the width direction and stacked on the first sheet on the stacking tray, an alignment operation by the alignment unit on the second sheet.

2. The sheet stacking apparatus according to claim 1, wherein, in a state in which one of the first alignment member and the second alignment member is held in contact with an upper surface of the first sheet, the alignment unit causes the other of the first alignment member and the second alignment member to abut a side end of the second sheet to align the second sheet.

3. The sheet stacking apparatus according to claim 1, wherein, in a case where the control unit prohibits the alignment operation on the second sheet, the control unit prohibits the alignment operation on a subsequent third sheet to be stacked on the second sheet, even if a size of the third sheet is same as a size of the second sheet.

4. The sheet stacking apparatus according to claim 1, wherein the alignment unit includes an elevating unit configured to raise or lower the first alignment member and the second alignment member, and wherein, if the alignment operation by the alignment unit on the second sheet is prohibited, the control unit raises the first alignment member and the second alignment member so that the first alignment member and the second alignment member may be spaced away from the upper surface of the first sheet.

5. A sheet stacking apparatus comprising:

a discharge unit configured to discharge a sheet;

a stacking tray on which the sheet to be discharged by the discharge unit is stacked;

an alignment unit configured to align the sheet stacked on the stacking tray in a width direction which is orthogonal to a direction in which the sheet is discharged, wherein the alignment unit includes first and second alignment members configured to move in the width direction and to come into contact with side ends in the width direction of the sheet stacked on the stacking tray to align the sheet, and wherein one of the first and second alignment members is placed on a first sheet in a case where a subsequent second sheet to be shifted in the width direction and stacked on the first sheet stacked on the stacking tray is aligned; and a control unit configured to prohibit, if a length of the second sheet is smaller than a length of the first sheet in the width direction, an alignment operation by the alignment unit on the second sheet in a case where the second sheet is shifted in the width direction and stacked on the first sheet on the stacking tray, and configured to cause, if the length of the second sheet is larger than the length of the first sheet in the width direction, the alignment unit to perform the alignment operation on the second sheet.

6. The sheet stacking apparatus according to claim 5, wherein if the positions of both side ends in the width direction of the second sheet stacked on the stacking tray are situated on an inner side of both side ends in the width direction of the first sheet, the control unit prohibits the alignment operation by the alignment unit on the second sheet.

7. The sheet stacking apparatus according to claim 5, wherein, in a state in which one of the first alignment member and the second alignment member is held in contact with an upper surface of the first sheet, the alignment unit causes the other of the first alignment member and the second alignment member to abut a side end of the second sheet to align the second sheet.

8. The sheet stacking apparatus according to claim 5, wherein the alignment unit includes an elevating unit configured to raise or lower the first alignment member and the second alignment member, and wherein, if the alignment operation by the alignment unit on the second sheet is prohibited, the control unit raises the first alignment member and the second alignment member so that the first alignment member and the second alignment member may be spaced away from the upper surface of the first sheet.

9. An image forming apparatus comprising:

an image forming unit configured to perform image formation on a sheet;

a discharge unit configured to discharge the sheet subjected to the image formation by the image forming unit;

a stacking tray on which the sheet to be discharged by the discharge unit is stacked;

an alignment unit configured to perform an alignment operation to align the sheet stacked on the stacking tray in a width direction which is orthogonal to a direction in which the sheet is discharged, wherein the alignment unit includes first and second alignment members operable to move in the width direction and to contact side ends in the width direction of the sheet stacked on the stacking tray to align the sheet, and wherein one of the first and second alignment members is placed on a first sheet in a case where a subsequent second sheet to be shifted in the width direction and stacked on the first sheet stacked on the stacking tray is aligned; and a control unit configured to prohibit, if a length of the second sheet in the width direction is different from a length of the first sheet in a case where the second sheet is shifted in the width direction and stacked on the first sheet on the stacking tray, an alignment operation by the alignment unit on the second sheet.

10. An image forming apparatus comprising:

an image forming unit configured to perform image formation on a sheet;

a discharge unit configured to discharge the sheet subjected to the image formation by the image forming unit;

a stacking tray on which the sheet to be discharged by the discharge unit is stacked;

an alignment unit configured to perform an alignment operation to align the sheet stacked on the stacking tray in a width direction which is orthogonal to a direction in which the sheet is discharged, wherein the alignment unit includes first and second alignment members operable to move in the width direction and to contact side ends in the width direction of the sheet stacked on the stacking tray to align the sheet, and wherein one of the first and second alignment members is placed on a first sheet in a case where a subsequent second sheet to be shifted in the width direction and stacked on the first sheet stacked on the stacking tray is aligned; and a control unit configured to prohibit, if a length of the second sheet is smaller than a length of the first sheet in the width direction in a case where the subsequent second sheet is shifted in the width direction and stacked on the first sheet stacked on the stacking tray, the alignment operation by the alignment unit on the second sheet, and configured to cause, if the length of the second sheet is larger than the length of the first sheet in the width direction, the alignment unit to perform the alignment operation on the second sheet.

* * * * *